US005775691A

United States Patent [19]

Hamano

[11] Patent Number: 5,775,691

[45] Date of Patent: Jul. 7, 1998

[54] MEDAL GAME MACHINE

[75] Inventor: Takashi Hamano, Kawasaki, Japan

[73] Assignee: Konami Co., Ltd., Kanagawa-ken, Japan

[21] Appl. No.: 856,177

[22] Filed: May 14, 1997

Related U.S. Application Data

[63] Continuation of Ser. No. 693,636, Aug. 9, 1996.

[30] Foreign Application Priority Data

Aug. 11, 1995 [JP] Japan ..... 7-205746

[51] Int. Cl.[6] ..... A63F 7/02

[52] U.S. Cl. ..... 273/138.2; 273/454; 273/138.3

[58] Field of Search ..... 273/138.1, 138.2, 273/138.3, 138.4, 138.5, 441, 459, 454; 453/1, 2, 18, 29, 58; 194/202, 215

[56] References Cited

U.S. PATENT DOCUMENTS

| | | | |
|---|---|---|---|
| 4,342,384 | 8/1982 | Fukase | 273/138.2 |
| 4,662,636 | 5/1987 | Crompton | 273/138.2 |
| 5,275,402 | 1/1994 | Malavazos et al. | 273/138.2 |
| 5,297,816 | 3/1994 | Becchio | 273/459 |
| 5,355,988 | 10/1994 | Shirasawa . | |
| 5,462,286 | 10/1995 | Roberts | 273/459 |
| 5,467,857 | 11/1995 | Takemoto | 273/138.2 |

FOREIGN PATENT DOCUMENTS

| | | |
|---|---|---|
| 0250226 | 12/1987 | European Pat. Off. . |
| 2014275 | 10/1971 | Germany . |
| 2124913 | 2/1984 | United Kingdom . |
| 2272383 | 5/1994 | United Kingdom . |
| 2293774 | 4/1996 | United Kingdom . |
| 8803299 | 5/1988 | WIPO . |

*Primary Examiner*—William M. Pierce
*Attorney, Agent, or Firm*—Greenblum & Bernstein P.L.C.

[57] ABSTRACT

A medal inserted from an insert slot is guided by a gap between a rear plate and a cover plate so as to fall onto a slide table. Upon allowing the medal to pass through a medal detection section, a slot game is started on a display. Then, when the patterns are not made uniform at all, then five medals are thrown in the vessel of the medal discharge unit. Also, after the medals are thus thrown in, when three of the same pattern are aligned with respect to all the symbols, the medals stored within the vessel of the medal discharge unit up to the time are discharged onto the slide table at one time.

10 Claims, 17 Drawing Sheets

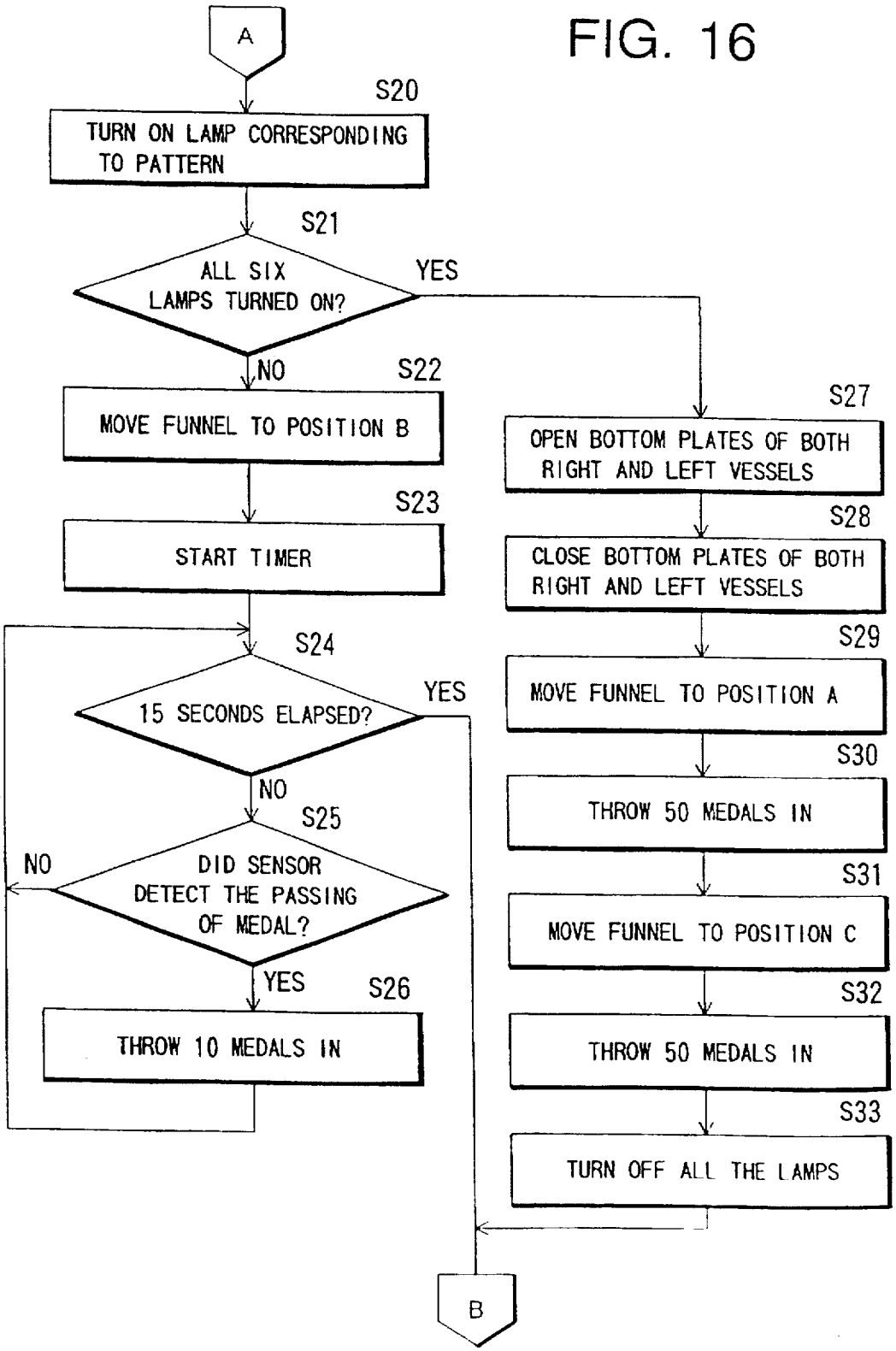
FIG. 16
A
S20
TURN ON LAMP CORRESPONDING TO PATTERN
S21
ALL SIX LAMPS TURNED ON?
YES
NO
S22
MOVE FUNNEL TO POSITION B
S23
START TIMER
S24
15 SECONDS ELAPSED?
YES
NO
S25
DID SENSOR DETECT THE PASSING OF MEDAL?
NO
YES
S26
THROW 10 MEDALS IN
S27
OPEN BOTTOM PLATES OF BOTH RIGHT AND LEFT VESSELS
S28
CLOSE BOTTOM PLATES OF BOTH RIGHT AND LEFT VESSELS
S29
MOVE FUNNEL TO POSITION A
S30
THROW 50 MEDALS IN
S31
MOVE FUNNEL TO POSITION C
S32
THROW 50 MEDALS IN
S33
TURN OFF ALL THE LAMPS
B

MEDAL GAME MACHINE

This application is a continuation, of application Ser. No. 08/693,636, filed Aug. 8, 1996, allowed.

BACKGROUND OF THE INVENTION

1. Field of the Invention

The present invention relates to a medal or token game machine in which medals inserted by a player are deposited on a table, and the medals deposited on the table are pushed out from an edge of the table by a wall portion that moves relatively with respect to the table so that the medals thus pushed out are paid back to the player.

2. Description of the Prior Art

A conventional medal game machine of this type has, in general, a slot through which a medal is inserted by a player. The medal insert slot is defined in the upper portion of the game machine. In the game machine, the medal which is inserted the medal insert slot falls into a game field while its trajectory of falling is being changed at random by a plurality of pins driven in a vertical fall surface. In the game field, a movable table having an upper surface to which the medal falls slidably reciprocates on a fixed table having a predetermined depth at a stroke shorter than the depth of the fixed table as well as the depth of the movable table itself. Also, at an edge portion of the fixed table (an edge portion opposite to another edge where a vertical fall board is disposed) are formed a pitfall that communicates with a passage through which the medal is paid back to the player. Also, a plurality of medals are deposited on the movable table and the fixed table in advance.

Then, the inserted medals which have been allowed to fall on the movable table are pushed out a predetermined distance toward a front edge portion of the movable table by the vertical fall board which is in slide contact with the upper surface of the movable table in the vicinity of the rear edge portion thereof while the movable table slidably retreats toward the vertical fall wall. Upon allowing the subject medal to be pushed out, other medals which have been deposited on the movable table are also pushed out together. In this situation, if the deposition of the medals on the movable table is sparse, then the gaps between the respective medals are merely made dense so that a few medal may fall from the upper surface of the movable table. However, if the deposition of the medals on the movable table is dense, the movement of pushing out the medals is transmitted to the medals which are situated on the front edge of the upper surface of the movable table, with the result that the some medals in the front edge of the upper surface of the movable table may fall from the upper surface of the movable table to the upper surface of the fixed table. The medals that have fallen to the upper surface of the fixed table are pushed out a predetermined distance toward the pitfall side by the front edge wall of the movable table while the movable table slidably advances toward the fall hole side of the movable table. With the operation of pushing out the medal, there is a case in which the medals fall to the pitfall as in the above-mentioned case of the medals on the upper surface of the movable table. The medals that have fallen in the pitfall is paid out to the player.

In the above-mentioned conventional medal game machine, although the player does not lose much (in other words, the total number of the medals paid back to the player is not much smaller than the total number of the inserted medals by the player), he does not win much. For that reason, the conventional medal game machine is low in amusingness, which does not stir up the player's speculative spirit. From this viewpoint, in the recent years, in order to enhance the speculativity of the medal game machine, there is a tendency to adopt a prize mechanism in which a prize slot is provided in the vertical fall board in such a manner that, when the medal inserted by the player enters the prize slot (that is, when winning the prize), a large number of medals which are prepared specially are cast out to the game field, thereby greatly increasing the number of medals which is paid back to the player.

However, any conventionally proposed prize mechanism is simply designed such that a fixed number of medals are cast out to the game field when winning the prize. Hence, the expected value of the number of refundable medals per one medal inserted by the player always remains constant. For that reason, since the player plays the game with the same expected value at all the times regardless of time when the player starts the game and when he finishes the game, he used to finish the game without hesitation. Therefore, the manager of an amusement arcade could not allow the player to be attracted to an identical medal game machine.

A prize mechanism disclosed in Japanese Patent Unexamined Publication No. Hei 6-269562 is so designed that one of prizes is elected when a predetermined condition is satisfied, and the medal(s) of the number according to the grade of the elected prize is(are) thrown in the game field. However, in such a prize device, even though the prize is elected by satisfying a predetermined condition, no medal is supplied in the case where the player fails to win any grade of the prize. In this case, the player is not rewarded at all for his effort made to satisfy the predetermined condition. Hence, there is a case in which the player loses a desire to continue the game and suspends the game.

In addition, since the merely supplying the medals onto the table one by one by the prize mechanism is entirely identical with the casting the medals by the player, there is demanded a medal supply mechanism which can pay back more medals.

SUMMARY OF THE INVENTION

The present invention has been made in view of the above circumstances, and therefore a first object of the present invention is to provide a medal game machine high in amusingness. The medal game machine is capable of gradually increasing the expected value of the number of refundable medals per one medal inserted by the player, thereby enabling the player to change his mind to abort the game. More over the medal game machine is capable of stackably supplying the medals onto the table, thereby allowing the player to expect a large number of refundable medals.

Another object of the present invention is to provide a medal game machine high in amusingness, in which, in the case where the election of the prize fails, the number of medals to be supplemented onto the table is increased when the prize is elected in the future so that the player is rewarded for his effort, with a result of being capable of keeping the player having a desire to continue the game.

According to a first aspect of the present invention, the above first object has been achieved by the provision of a medal game machine, which comprises: a table having an upper surface on which medals are located; medal pushing member that relatively slidably moves along the upper surface of the table, for pushing the medals located on the upper surface of the table toward an edge of the upper surface of the table; a guide for guiding medals to the upper surface of the table according to operation by a player; a vessel accommodating medals; a first supply mechanism for supplying the medals accommodated in said vessel to the upper surface of said table when a first condition is satisfied; and a medal increasing mechanism for increasing the number of medals accommodated in said vessel according to a second condition.

According to the medal game machine, the medals are located on the upper surface of the table while the medal being guided by the guide according to the player's operation. The medals are pushed out by the medal pushing member and then extrudes other medals which have been already located on the table. With this extruding operation, the medals that fallen from the table is paid back to the player. Then, if the second condition is satisfied during the game, then the medal increase means increases the number of medals in the vessel. Also, if the first condition is satisfied during the game, then the first supply mechanism moves the bottom plate so as to open the bottom of said vessel, thereby supplementing the medals onto the table from the vessel. The number of medals which have been supplied on to the table increases with an increase of the number of medals by the medal increasing mechanism. Hence, the expected value of the number of refundable medals per one inserted medal becomes increased more with the increase of the number of medals by the medal increasing mechanism. Since the supplement of medals is conducted at one time by opening the bottom of the vessel, the supplemented medals are stacked on the table, which is different from a case in which the medals are guided by the guide. As a result, the stream of the game is changed at one time.

Both the table and the medal pushing member may be so arranged as to be movable. Alternatively, the table may be fixed while the medal pushing member is movable, or the medal pushing member may be fixed while the table is movable. Also, the table may be double structure which consists of two tables, a lower table and an upper table. In this case, a lower table is formed of a fixed table while an upper table is formed of a slide table. The front edge surface of the upper table serves as the medal pushing member for the lower table, and a wall surface or the like is used as the medal pushing member for the upper table.

Since the guide is so designed as to guide the medals onto the table in accordance with the player's operation, it may be formed of a guide that slidably falls the medals thrown in by the player onto the table, or a mechanism by which the medals which have been stocked, in accordance with the player's operation, in the interior thereof are fallen by an actuator. Also, the guide may be arranged to guide the medals along a fixed track, or to guide the medals at random by using a plurality of passages. For example, the coins may be allowed to pass a widened passage made by driving a large number of nails in like a board of the pin ball game or the Corinthian game.

The first supply mechanism may supplement the medals through the guide or through a supplement path which is a route different from the guide. The first condition which serves as a trigger that allows the first supply mechanism to supply the medals may be that the medals pass through a specified location within the guide or that the medals that falls from the table falls to a specified position.

The medal increasing mechanism is so designed as to additionally throw a predetermined number of medals in the vessel. The second condition which serves as a trigger that allows the medal increasing mechanism to increase the medals may be a time condition or a condition in which the medals pass through a specified location. It should be noted that the probability that the second condition is satisfied is desirably lower than the probability that the first condition is satisfied.

Also, according to a second aspect of the present invention, the above second object has been achieved by the provision of a medal game machine, which comprises: a table having an upper surface on which medals are located; a medal pushing member that relatively slidably moves along the upper surface of the table, for pushing the medals located on the upper surface of the table toward an edge of the upper surface of the table; a guide for guiding medals to the upper surface of the table according to operation by a player; a vessel accommodating; a first supply mechanism for supplying the medals accommodated in said vessel to the upper surface of said table when a first condition is satisfied; an electing mechanism for electing prizes when a third condition is satisfied, and a medal casting mechanism for casting a predetermined number of medals in said vessel when the prizes have not been elected by the electing mechanism.

The first supply mechanism may be so designed that the medals to be supplemented onto the upper surface of the table are stocked within the vessel in advance, or that the number of medals to be supplemented is provided as numerical data, and the medals are supplemented while the quantity of medals is managed in accordance with that numerical data.

The third condition for electing the prize by the electing mechanism may be that the medals pass through a predetermined position within the guide, or that the time condition is satisfied.

In the case where the supply mechanism is of the system in which the medals to be supplemented are stocked within the vessel in advance the medal increasing mechanism may be so designed as to additionally throw a predetermined number of medals into the vessel. Also, in the case where the first supply mechanism provides the number of medals to be supplemented as a numerical value, the numerical value may be added.

Further, according to a third aspect of the present invention, in the medal game machine of the second aspect, said first condition is that a first prize is elected plural times by said electing mechanism. With this feature, since the probability that the first condition is satisfied becomes high every time the first prize is won, the expected value is increased as much.

Still further, according to a fourth aspect of the present invention, in the medal game machine of the third aspect, there is further provided second supply mechanism for supplying a given number of medals to the upper surface of said table in the medal game machine of the third aspect, when a second prize which is higher in the probability to be elected than the first prize is elected by said electing mechanism. With this feature, since the medals are thrown in the table even before the first condition is satisfied, the player is not tired of playing the game.

Yet still further, according to a fifth aspect of the present invention, in the medal game machine of the third aspect, said guide has a plurality of passages and guides said medals via one passage of said a plurality of passages which is determined at random, there is further provided detection member, for detecting a medal at any position of said plurality of passages in the passage, to satisfy the third condition.

Yet still further, according to a sixth aspect of the present invention, in the medal game machine of the fifth aspect, there is further provided third supply mechanism for supplying a given number of medals onto the upper surface of said table every time a medal is detected by said detection member during a given period of time after said first prize is elected by said electing mechanism.

Yet still further, according to a seventh aspect of the present invention, in the medal game machine of the fifth aspect, said detection member moves between said plurality of passages within said guide. With this arrangement, it becomes hard to take aim so that the medals are guided at a position where the medals are detected by the medal passing detection member. Hence, the player is not tired of playing the game.

Yet still further, according to an eighth aspect of the present invention, in the medal game machine of the first aspect, the guide includes a plurality of protrusions that collide with said medals thrown in by the player whereby the collision of the protrusions with the medals makes the passage of said medals change at random.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 16 is a flowchart showing the contents of the control processing which is executed in the CPU of FIG. 14;

DETAILED DESCRIPTION OF THE PREFERRED EMBODIMENTS

Now, a description will be given in more detail of embodiments of the present invention with reference to the accompanying drawings.

(The overall structure of a medal game machine)

Figure 1:
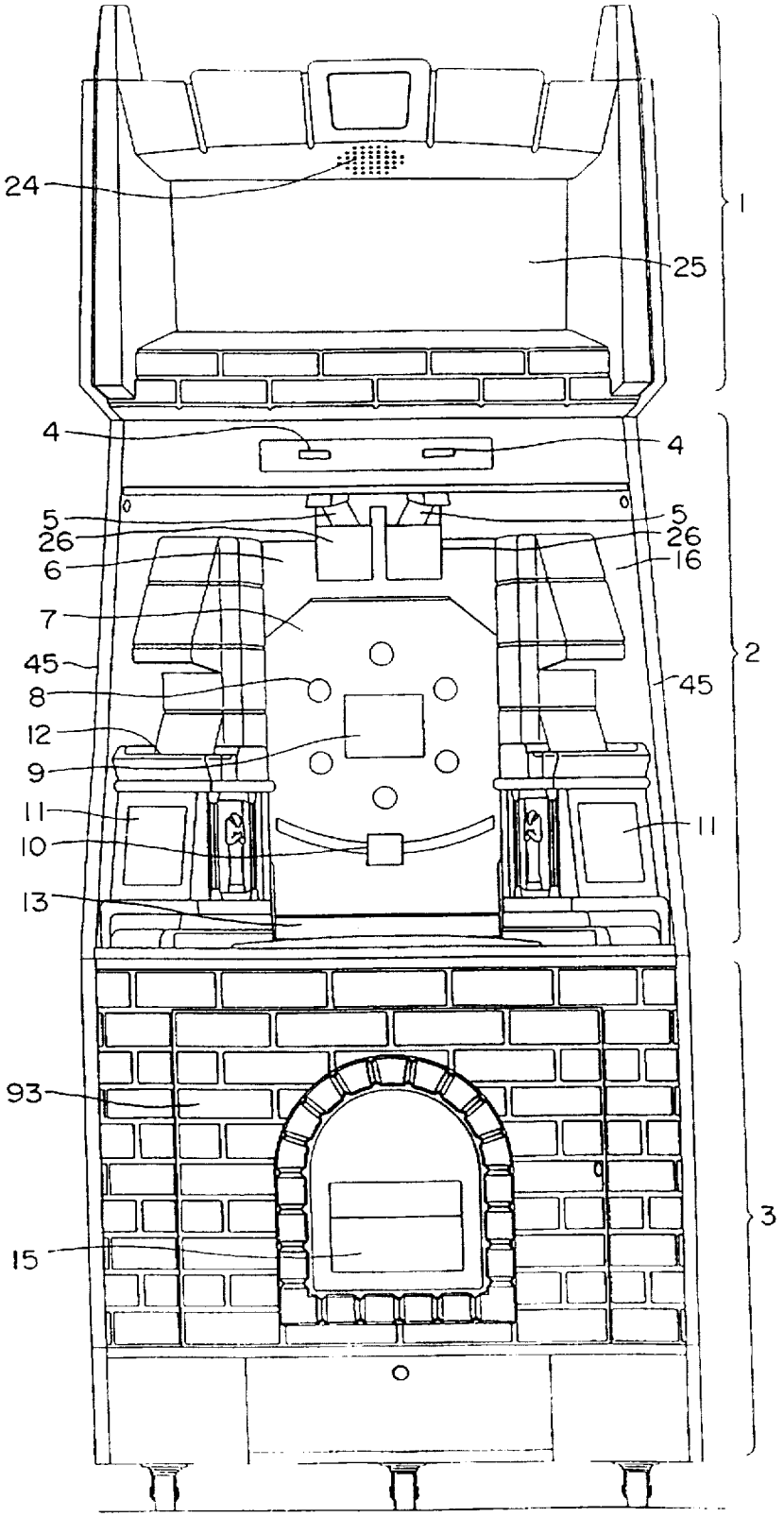
FIG. 1 is a front view showing a medal game machine in accordance with an embodiment of the present invention.
Figure 2:
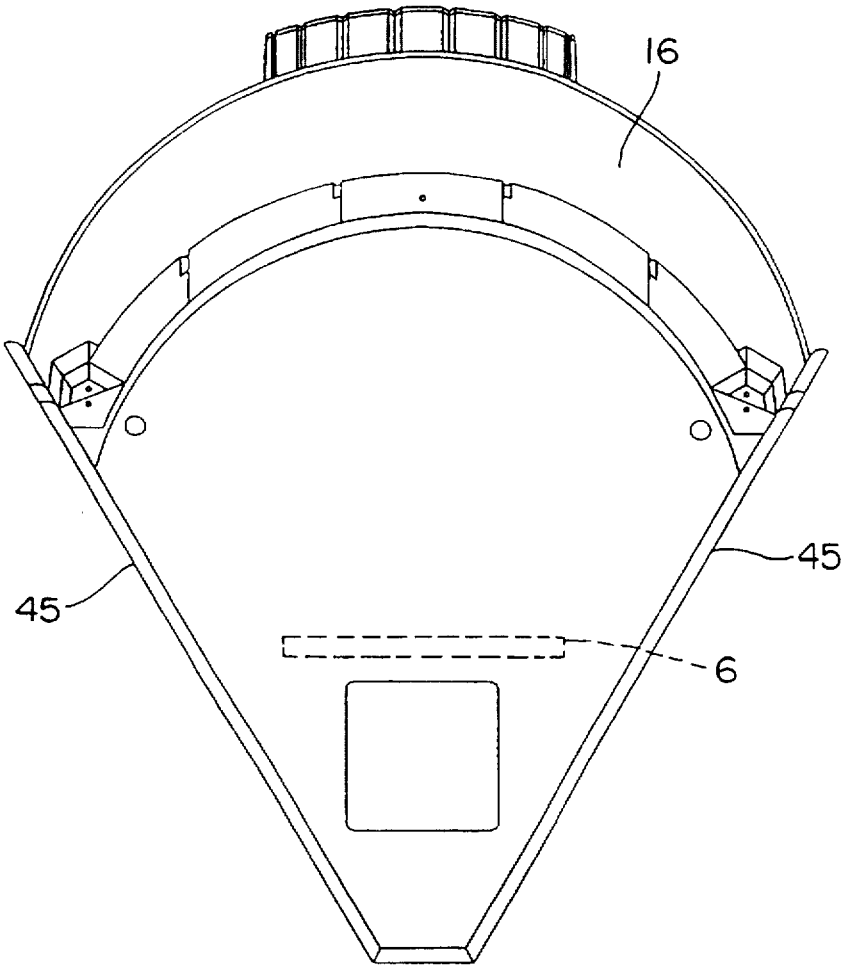
FIG. 2 is a top view showing the medal game machine of FIG. 1.

FIG. 1 is a front view showing a medal game machine which embodies the present invention, and FIG. 2 is a top view thereof. As shown in FIG. 1, the medal game machine is made up of an illumination and sound section 1, a game playing section 2 and a medal collect section 3 in the stated order from the top. Also, when the medal game machine is viewed from the top, as shown in FIG. 2, the medal game machine is fan-shaped with 60 degrees with a rear end as a center. Hence, the respective side walls 45 of six medal game machines are brought in contact with each other in such a manner that those medal game machines are arranged in the form of a circle.

The game playing section 2 is sectioned by a rear plate 6 set up vertically at a position shown in FIG. 2 into a game field in front of the rear plate 6 and a machine section at the rear of the rear plate 6. The game field is a space which is covered with an acrylic plate 16 that is in the form of a conical surface. The acrylic plate 16 is equipped in the front face of the medal game machine. The game field is a field where a game progresses while its state is observed by the player. A front upper portion of the game playing section 2 are provided with two medal insert slots 4 through which the medals are cast in the game field by the player. There is provided a medal supply mechanism which is covered with two covers 11 which is decorated with the Egypt shrine like design, along the side walls 45 from the side edges of the rear plate 6 within the game field. A state in which the structure of the medal supply mechanism is exposed by detaching the covers 11 therefrom is shown in the perspective view of FIG. 3. Also, the structure of the mechanical section in the game playing section 2 is shown in the partially perspective rear view of FIG. 4.

The outer surface of the illumination and sound section 1 is provided with holes 24 that lead a sound outputted from a loudspeaker 99 (refer to FIG. 8) and an illumination unit 25.

Figure 4:
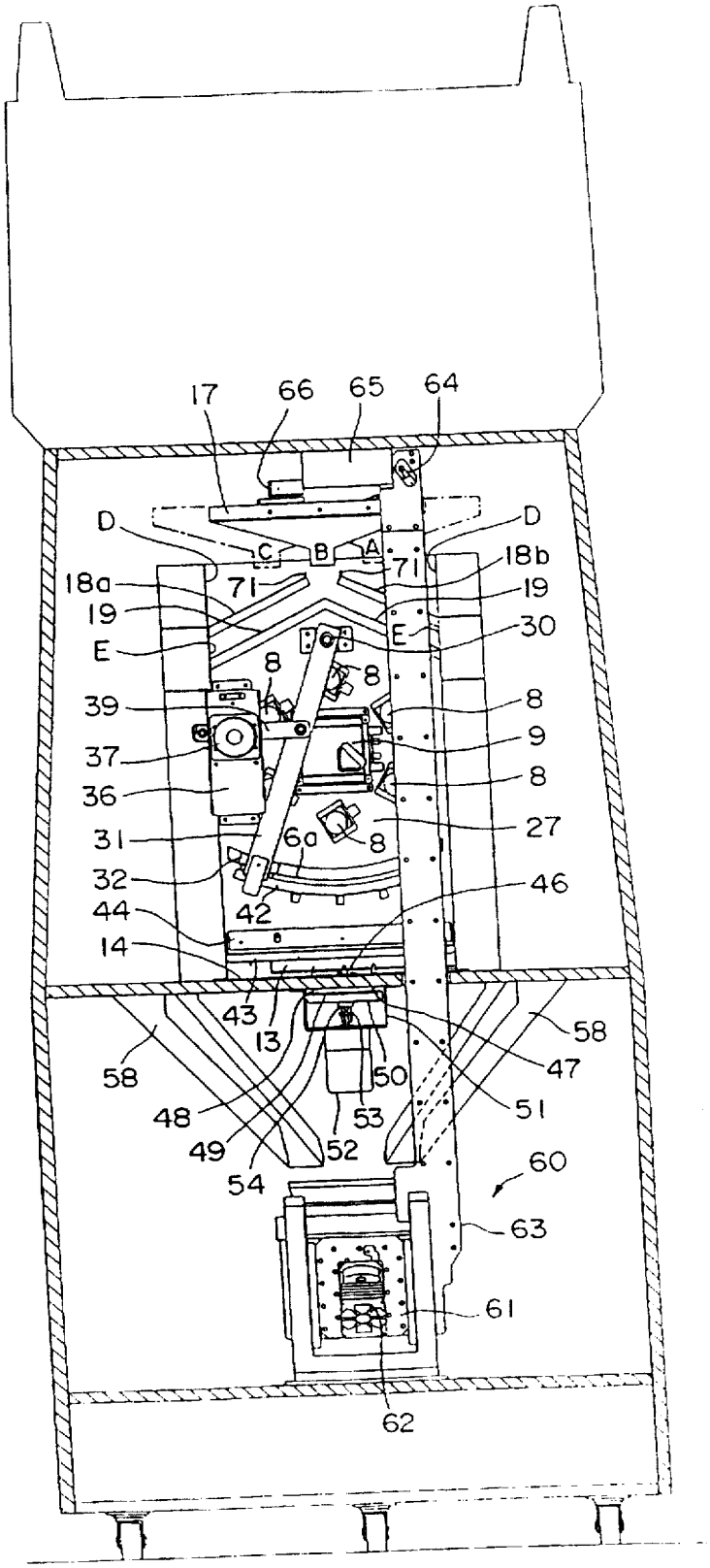
FIG. 4 is a partially perspective rear view showing the medal game machine of FIG. 1.
Figure 8:
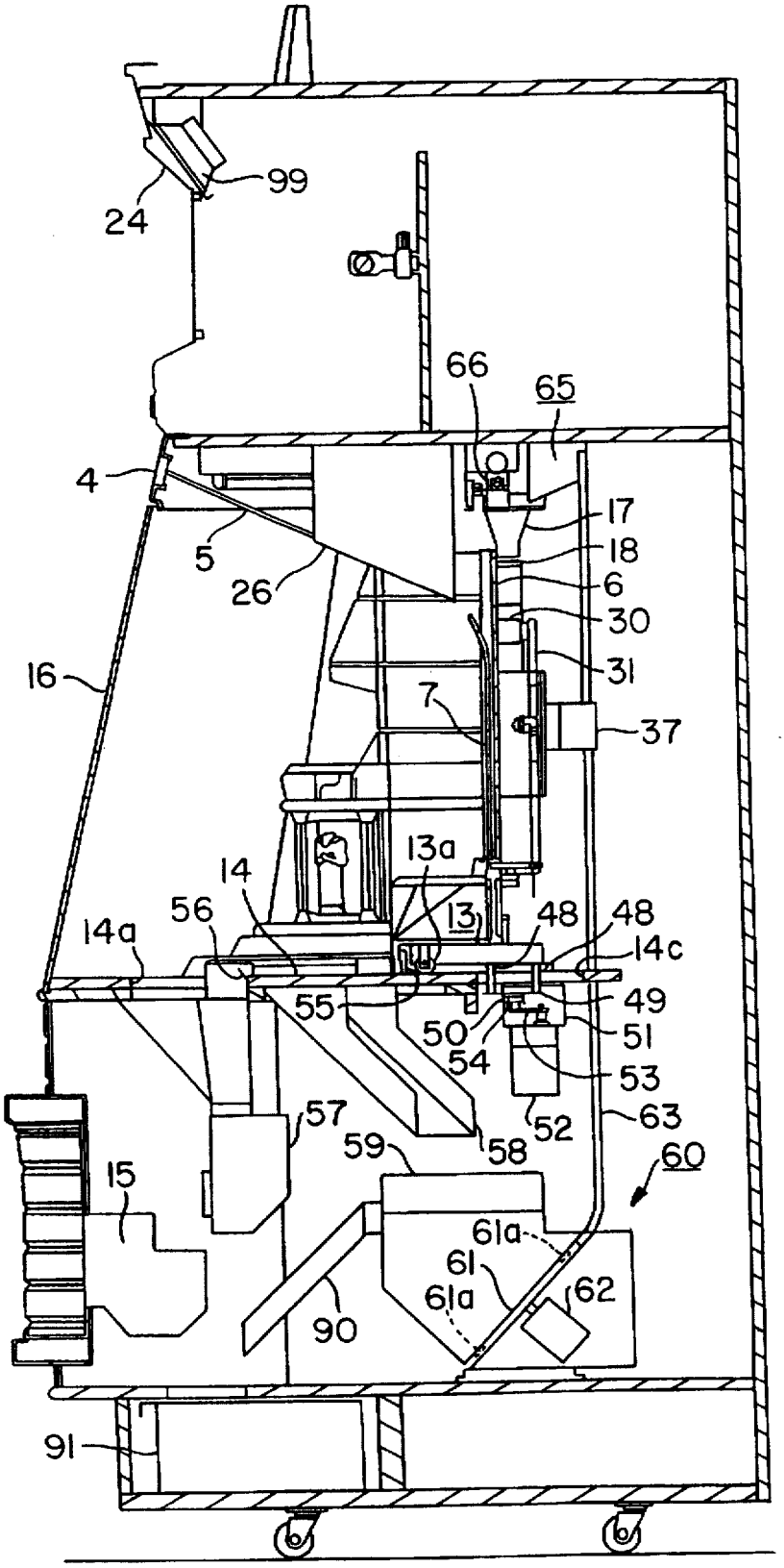
FIG. 8 is a vertical cross-sectional view showing the medal game machine of FIG. 1 along its center line.

The medal collect section 3 is so designed that the medals that have fallen from the game field are delivered to a pay-back outlet 15 on the outer surface thereof, and medals are supplied to the medal supply mechanism after they are once stocked in a medal stock box 59 (refer to FIG. 8) in the interior thereof. The internal structure of the medal collect section 3 is shown in FIGS. 4 and 8. Since the medal collect section 3 is freely opened and closed with a cover 93 disposed in front thereof, the operator of this medal game machine can recover the medals stocked in the medal stock box 59 as the winning share of a banker.

Hereinafter, a description will be given in more detail of the respective parts.

(Medal cast mechanism)

Figure 5:
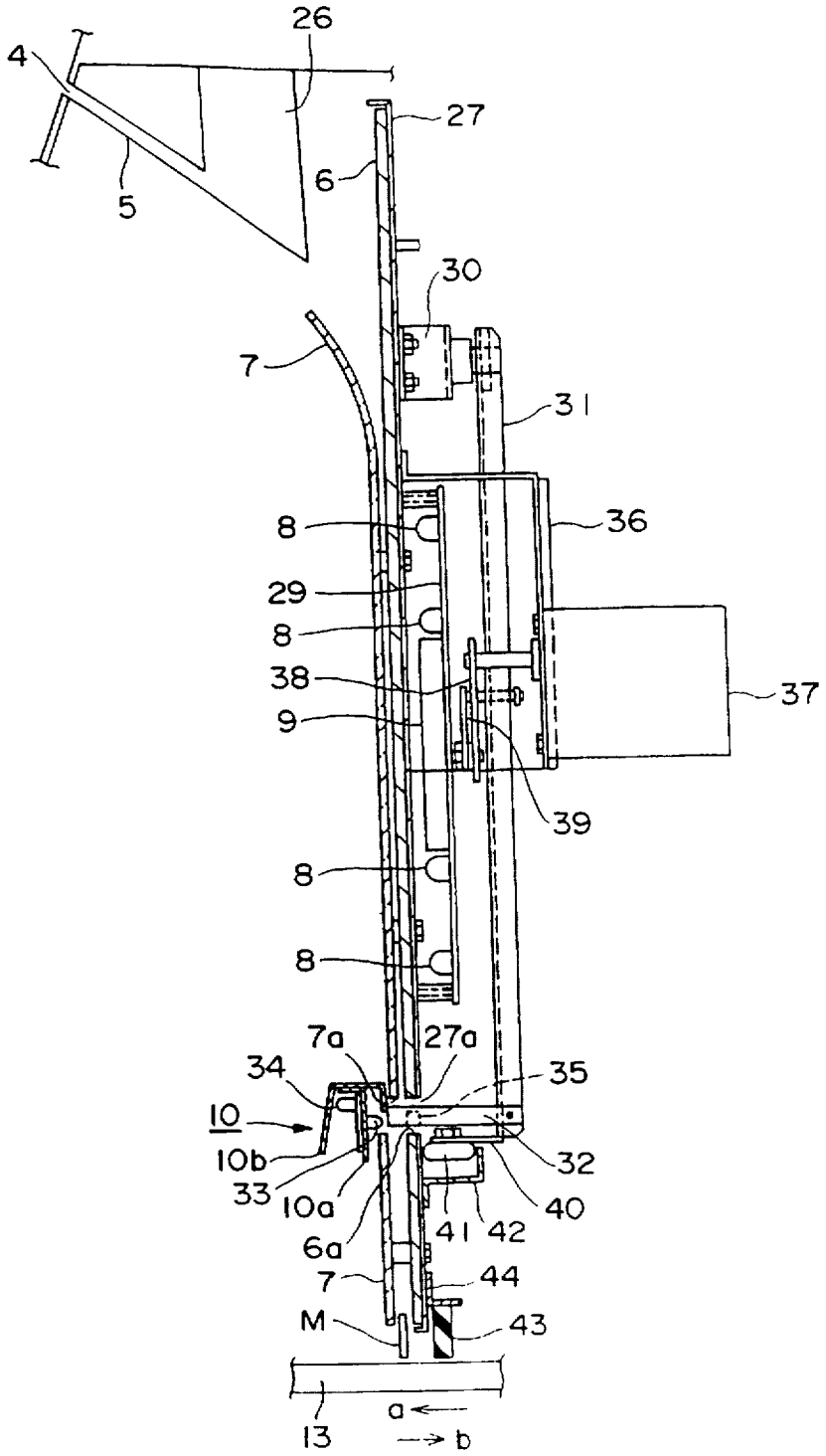
FIG. 5 is a vertical cross-sectional view showing the vicinity of a rear plate 6 and a guide plate 7.

As shown in FIGS. 1 and 2, the medals inserted from the respective medal insert slots 4 are guided by widened slides 26 that suspend from the ceiling of the game field after passing through square pipe shaped guides 5, and then slide down on the slides 26. The rear plate 6 is positioned in the front end of the slides 26 (See FIG. 5). A transparent acrylic guide plate 7 is fixed above the front surface of the rear plate 6 with a gap slightly larger than the thickness of the medal between the guide plate 7 and the rear plate 6. Since the guide plate 7 is curved, as shown in FIG. 5, in such a manner that its upper end is curved to draw a curve at the front side, the medals that have fallen from the slides 26 can be lead to the gap between the rear plate 6 and the guide plate 7. A steel reinforcement plate 27 is fitted onto the back surface of the rear plate 6, so that the mechanical strength of the rear plate 6 is enhanced, and the respective mechanical parts forming the mechanical section of the game playing section 2 can be fixed to the reinforcement plate 27.

Figure 6:
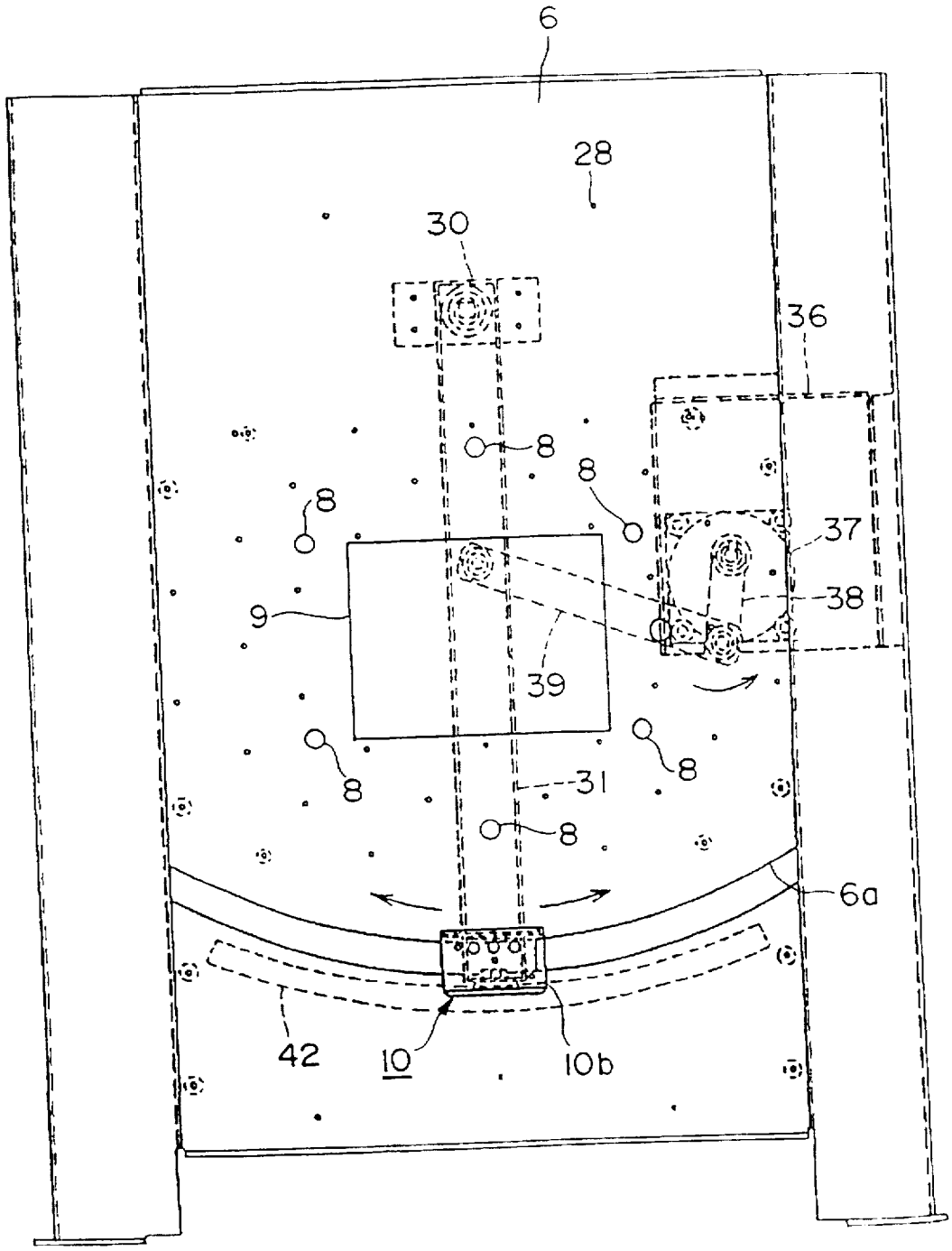
FIG. 6 is an enlarged front view showing the rear plate 6 and the guide plate 7.

A large number of pins 28 are driven in the gap between the rear plate 6 and the guide plate 7, as shown in FIG. 6. Hence, the medals, which are introduced from the upper portion of the guide plate 27 into the gap, fall into the gap while its trajectory of falling is changed at random by colliding against pins 28. In this embodiment, the rear plate 6 and the guide plate 7 correspond to guide. Spaces between respective pins 28 in the interior of the guide form passages along which the medals are guided.

Figure 18A:
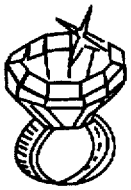
FIGS. 18A to 18F are diagrams showing the patterns of characters.
Figure 18B:
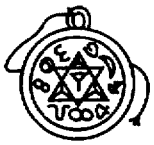
Figure 18C:
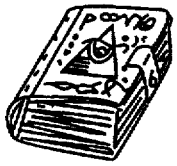
Figure 18D:
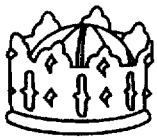
Figure 18E:
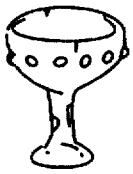
Figure 18F:
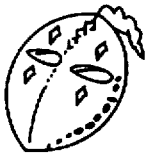

The rear plate 6 is made of acrylic resin and patterns thereof are printed on the rear plate 6 with an opaque coating. In FIG. 1, however, portions which are denoted by reference numerals 9 and 8 remain transparent as they are. In the rear side of those portions, as shown in FIG. 5, a steel frame 29 is fixed to the rear surface of the reinforcement plate 27 with a gap therebetween. To the surface of the frame 29 at the side of the reinforcement plate 27 are fitted a display device 9 which is made up of a liquid-crystal display unit that coincides with the square transparent portion formed in the center of the rear plate 6, and six lamps 8 that coincide with six circular transparent portions formed in the periphery of the square transparent portion. Symbols associated with the respective lamps 8 are drawn in the vicinity of the transparent portions of the rear plate 6, which coincide with the respective lamps 8. The kinds of the symbols are shown in FIGS. 18A to 18F. FIG. 18A shows an "emerald ring", FIG. 18F is a "silver medallion", FIG. 18C is a "book of secrets", FIG. 18D is a "ruby crown", FIG. 18E is a "Holy Grail", and FIG. 18F is a "golden mask".

Also, as shown in FIGS. 5 and 6, there are formed circular arc slits 6*a* and 7*a* with a point positioned in the center line drawn vertically as a center, in the vicinity of the lower ends of the rear plate 6 and the guide plate 7. Similarly, the reinforcement plate 27 has a circular arc slit 27*a* so as to coincide with the slit 6*a*.

A support member 32 of a medal detecting section 10 which swings on a locus of the radius of curvature which is identical with that of those slits 6*a*, 7*a* and 27*a* penetrates those slits 6*a*, 7*a* and 27*a*. The specified structure of the medal detecting section 10 and the structure of its swinging mechanism will be described with reference to FIGS. 4 and 5.

The medal detecting section 10, as shown in FIGS. 4 and 5, is fitted through the support member 32 to one end of a swing arm 31. The other end of the swing arm 31 is axially supported to a base shaft 30. The base shaft 30 is fitted to the rear surface of the reinforcement plate 27 above the display 9. The support member 32 is made up of two plate members which have base ends fitted to both side surfaces of the swing arm 31, and which penetrate the slits 6*a*, 7*a* and 27*a*. The medal detecting section 10 is fitted so as to be put across the tips of those two plate members of the support members 32. The gap between those two plate members is slightly larger than the diameter of the medal, so that the falling medals can pass through that gap. In other words the gap functions the medal passing position.

The medal detecting section 10 is made up of a mount plate 10*a* which is arranged in parallel to the guide plate 7 as to be opposite to the gap between said two plate members, and a decorative sheet 10*b* which is so supported as to cover the mount plate 10*a*. To the surface of the mount plate 10*a* at the side of the decorative sheet 10*b* are fitted three display elements 34 each of which are formed of a light emission diode. The portions of the decorative plate 10*b* in correspondence with the display elements 34 are transparent so that the player can view the light emitted from the display elements 34.

Also, to the surface of the mount plate 10*a* at the side of the support members 32 are fitted to a light emitting element 33. The light emitted from the light emitting element 33 is received by a light receiving element 35 which is interposed between the two plate members of the support member 32 at a position opposite to the light emitting element 33. These element 33 and 35 are apart in order to make the respective medal passing positions. In this embodiment, the light emitting element 33 and the light receiving element 35 make up of a medal passing sensor (medal passing detection member), and a signal representative of the passing of the medal between the two plate members of the support members 32 can be outputted as a change of an electric signal from the light receiving element 35.

On the other hand, on the rear surface of the reinforcement plate 27 at the outside of the swingable range of the swing arm 31 is fitted a bracket 36 which is apart from the reinforcement plate 27 farther than the swing arm 31. A sensor swing motor 37 is fitted onto the back surface of the bracket 36. The rotary shaft of the sensor swing motor 37 penetrates the bracket 36 and is fitted to one end of a first arm 38 that rotates together with the rotary shaft. The other end of the first arm 38 is pivotably fixed to one end of a second arm 39 longer than the first arm 38. The other end 39 of the second arm is pivotably fixed to the middle portion of the swing arm 31. With such a crank mechanism structure, upon the rotation of the first arm 38 by the sensor swing motor 37, the second arm 39 reciprocates as a crank rod in such a manner that the swing arm 31 swings with a given angle range. It should be noted that the length of the first arm 38, the length of the second arm 39, and the respective pivotably fixed positions of the second arm 39 and the swing arm 31 are appropriately selected in order to set the swing range of the swing arm 31 within a required range.

To the end portion of the swing arm 31 is fixed a stripe roller mounting member 40 toward the same direction as the longitudinal direction of the support member 32. At the tip of the roller mounting member 40, a roller 41 is rotatably axially supported by a shaft disposed in parallel with the longitudinal direction of the swing arm 31. On the other hand, a restriction member 42 which is substantially L-shaped in section is fitted to the rear surface of the reinforcement plate 27 in such a manner that it is curved in a circular arc along the moving locus of the roller 41. A gap between the restriction member 42 and the reinforcement plate 27 is slightly broader than the diameter of the roller 41. Hence, with the swing of the swing arm 31, since the roller 41 moves within the gag between the restriction member 42 and the reinforcement plate 27, the medal detecting section 10 is not away from or brought in contact with the rear plate 6.

It should be noted that the slit 7*a* divides the guide plate 7 into upper portion and lower portion. The lower portion is spaced from the rear plate 6 more than the upper portion. This is to prevent the medal M that has fallen between the guide plate 7 and the rear plate 6 from flying out from the slit 7*a* outwardly, and also to ensure a space where the medal falls down at the lower ends of the guide plate 7 and the rear plate 6. In other words, the lower ends of the guide plate 7 and the rear plate 6 are in contact with the upper surface of a slide table 13 that forms the lower surface of the game field, the lower ends having a gap which is slightly shorter than the diameter of the medal. Hence, even though the medal M that falls between the guide plate 7 and the rear plate 6 has dropped on the slide table 13, the guide plate 7 and the rear plate 6 prevent the medal from flying out. While being thus structured in the lower portion of the guide plate 7 and the rear plate 6, since a space between the guide plate 7 and the rear plate 6 is broad, the medal A can fall down on the slide table 13 with the movement of the slide table 13 in a direction indicated by an arrow a.

Also, at the rear side of the lower end of the reinforcement plate 27, a wiper member 43 is fitted through a bracket 44 which is L-shaped in section. Since the bracket 44 is fitted to the reinforcement plate 27 so as to be movable vertically, a gap between the wiper member 43 and the slide table 13 is adjustable. Normally, the gap is so adjusted as to be narrower than the thickness of the medal M. In this case, with the movement of the slide table 13 toward a direction indicated by an arrow b, the medal M that has fallen down on the upper surface of the slide table 13 is abutted against the wiper member 43, thereby preventing its absolute movement, with the result that the medal M is pushed out relatively toward the front end side on the slide table 13. In this embodiment, the wiper member 43 corresponds to medal pushing member.

(Table Mechanism)

Figure 7:
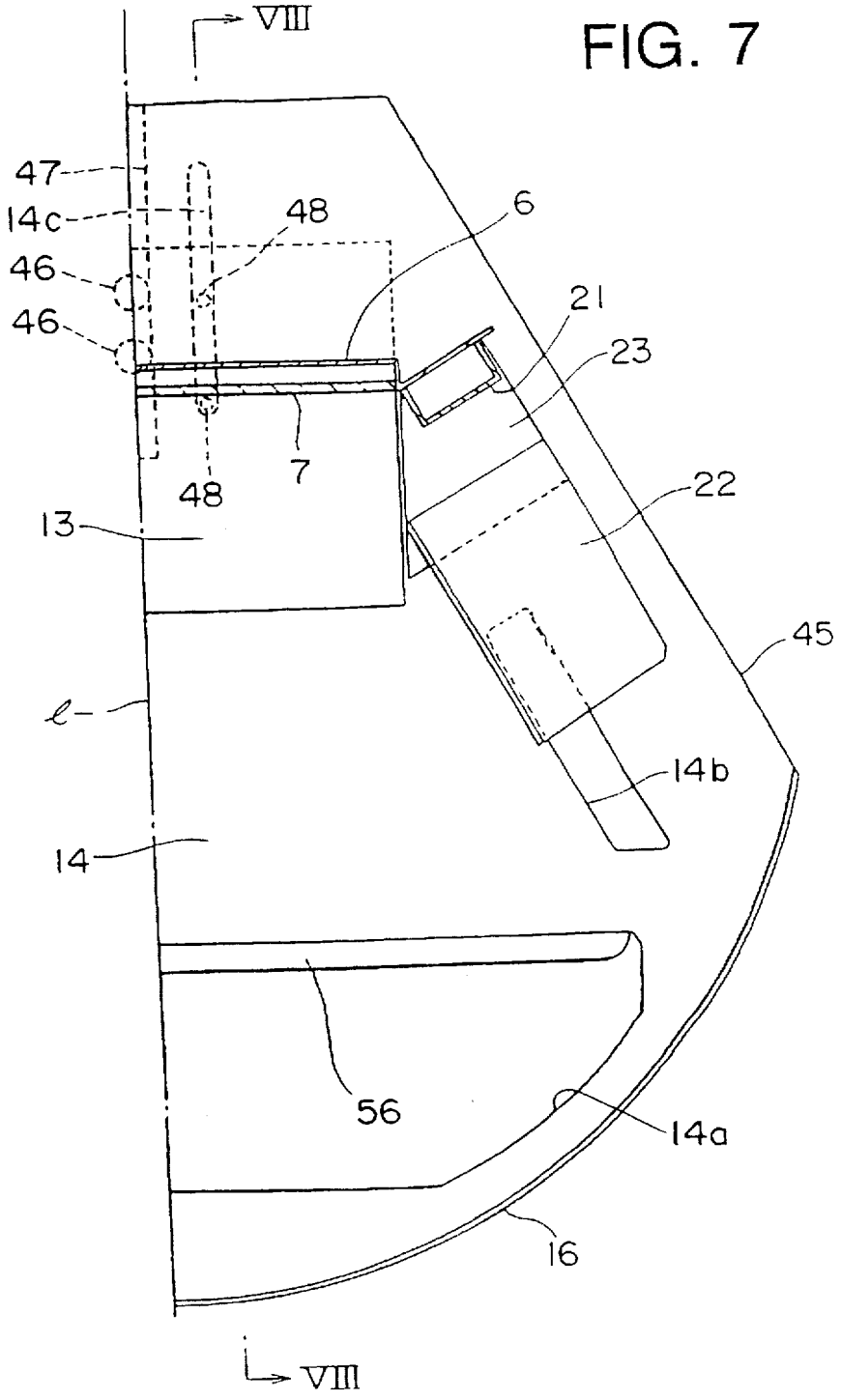
FIG. 7 is a lateral cross-sectional view showing the medal game machine taken along a line VII-VII of FIG. 3 in which a part of the machine is omitted.

Subsequently, a table mechanism having the slide mechanism of the slide table 13 will be described. FIG. 7 is a lateral cross-sectional view showing the medal game machine taken along a line VII—VII of FIG. 3 viewed from the upper in which a part of the machine is omitted. FIG. 7 shows the lower surface of the game field having a linearly symmetric structure in which one side of its center line 1 is omitted. Also, FIG. 8 is a vertical cross-sectional view taken along a line VIII—VIII of FIG. 7.

As shown in FIG. 7, the entire lower surface of the game field is structured as a surface disposed horizontally. The front side of that lower surface has a medal pitfall 14*a* having an edge orthogonal to the center line 1 formed. Also, medal collect holes 14*b* having an edge which are in parallel with the side walls 45 of the game field are formed on both sides of the game field. A substantially trapezoidal region surrounded by the medal pitfall 14*a*, the two collect holes 14*b* and the rear plate 7 is formed as a fixed table 14. The slide table 13 as a table on which the medal is located reciprocatingly slides on the fixed table 14 in parallel with the center line 1 of the fixed table 14.

As shown in FIG. 8, the lower end edges of the cover plate 7 and the rear plate 6 are spaced from the fixed table 14 by a slight amount. Thereby a gap in which the rear end side of the slide table 13 can be entered is formed between the lower edges of those plates 7, 6 and the table 14. The slide table 13 slides so as to move within the gap forward and backward. The front side of the lower surface of the slide table 13 is fitted with a roller 13*a* for reducing the friction resistance in sliding. Also, at the back side of the lower surface of the slide table 13, two slide protrusions 46 are protruded at two portions along the center line 1 (refer to FIG. 7). The two protrusions 46 make the slide table 13 kept horizontally while maintaining a space, which is formed by aid of the roller 13*a*, between the slide table 13 and the fixed table 14.

A slide rail 47 is formed in the center line 1 of the fixed table 14 so as to guide those two slide protrusions 46 along the center line 1 (refer to FIG. 7). Also, two slits 14*c* are formed in parallel with the slide rail 47 on both sides of the slide rail 47.

Two connecting pins 48 which are disposed on the lower surface of the slide table 13 are penetrated in the penetrating grooves 14*c*. The lower ends of the connecting pins 48 are connected to a slide plate 49 disposed in parallel with the fixed table 14. Hence, the slide table 13 is slidable with respect to the fixed table 14 within a range where the connecting pins 48 are movable within the penetrating grooves 14*c*. In this situation, because the slide protrusions 46 are regulated in position by the slide rail 47, quivers of the slide table 13 within the plane can be prevented.

A slide rail 50 which is substantially C-shaped in section is fixed to the lower surface of the slide plate 49 toward a direction orthogonal to the center line 1. A bracket 51 which is opened in the sliding direction of the slide plate 49 is fixed to the lower surface of the fixed table 14 so as to cover the slide plate 49. A table drive motor 52 is attached to the lower surface of the bracket 51. The rotary shaft of the table drive motor 52 penetrates the bracket 51 and is fixed to one end of a rotating arm 53 that rotates together with the rotating shaft. A roller 54 which is inserted within the slide rail 50 and is movable forward and backward along the slide rail 50 is rotatably fitted to the other end of the rotating arm 53.

Hence, with the rotation of the rotating arm 53 by the table drive motor 52, the roller 54 disposed on the tip of the rotating arm 53 presses the slide rail 50, whereby the slide table 13 is slid in the direction of the center line 1. The stroke of sliding of the slide table 13 is twice as long as the overall length of the rotating arm 53. Therefore, the overall length of the slide table 13 is appropriately selected within a range where it is half of the overall length of the slide rail 50, or shorter, thereby being capable of changing the stroke of the slide table 13. The stroke of the slide table 13 is set to be remarkably shorter than the overall length of the slide table 13 in the sliding direction thereof. As a result, the whole slide table 13 is not moved toward the depth direction, the whole slide table 13 is not moved toward the front side from the rear plate 6, and the front end of the slide table 13 does not reach the medal pitfall 14a beyond the fixed table 14.

As shown in FIG. 8, the upper tip of the slide table 13 is slightly warped toward the upper side so that the medals fall uniformly from the entire slide table tip in its width direction. The wiper member 55 is fitted to the vicinity of the lower tip of the slide table 13 in such a manner that the medal is prevented from entering a gap between the slide table 13 and the fixed table 14, and the medal on the fixed table 14 is surely pushed out. Moreover, a flap 56 which is slightly inclined upward is fitted to the end of the medal pitfall 14*a* at the side of the fixed table 14 so that the medals fall in the medal pitfall 14a uniformly from the entire fixed table 14 in the width direction.

(Medal Collect Mechanism)

Subsequently, referring to FIGS. 4 and 8, the medal collect mechanism will be described. The medal that has fallen from the medal pitfall 14*a* is guided to a pay-back outlet 15 through a guide 57. The medal that have fallen from the medal collect hole 14*b* is led to the medal stock box 59 through the guide 58 before being stocked. It should be noted that, in the case where the medal stock box 59 is filled with the medals, the medals that have brimmed over the medal stock box 59 are stored in a cashbox 91 through a guide 90.

(Medal Supply Mechanism)

Then, the medal supply mechanism for supplying the medals stocked within the medal stock box 59 to the game field will be described. As shown in FIGS. 4 and 8, a draw-up disc 61 that forms a medal hopper 60 is rotatably fitted to the lower surface of the medal stock box 59 in such a manner that the draw-up disc 61 is rotatably driven by a hopper drive motor 62. A plurality of medal receiving holes 61*a* into which the medals are inserted in accordance with the rotation of the draw-up disc 61 are defined at a corresponding number of positions along the circumferential direction of the draw-up disc 61. The medals which have been inserted into the medal receiving holes 61*a* are forcedly pressed into a draw-up conduit 63 that forms the medal hopper 60 similarly as the rotation of the draw-up disc 61 progresses. The draw-up conduit 63 is formed of a rectangular pipe having an internal passage the width of which is the substantially same as the diameter of the medal and the thickness of which is the substantially same as the thickness of the medal, and is disposed nearly vertically in such a manner that its tip reaches the upper portion of the game playing section 2.

As the pressing of the medal into the draw-up conduit 63 by the draw-up disc 61 progresses, a medal which has been pressed into the draw-up conduit 63 at the first lifts up to the tip of the draw-up conduit 63. The tip of the draw-up conduit 63 is equipped with a medal counter 64 that sends out the medal which reaches the tip of the draw-up conduit 63 toward the sides and counts the medals which have been delivered. The structure of the medal counter 64 will be described with reference to FIG. 9 showing a top view of the structure in the vicinity of the tip of the draw-up conduit 63.

Figure 9:
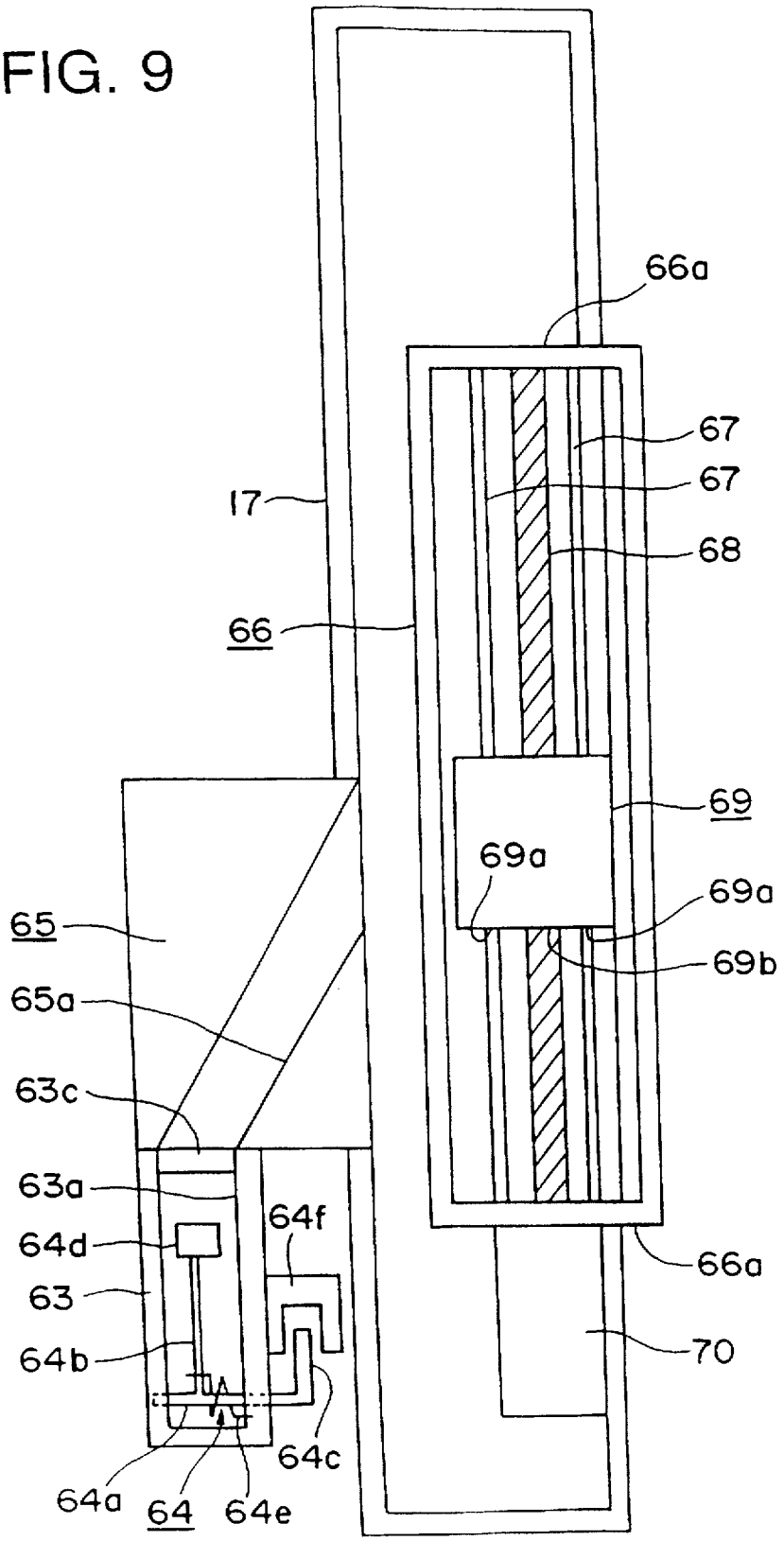
FIG. 9 is a top view showing the vicinity of an upper end of a draw-up tub.

As shown in FIG. 9, in the upper end of the draw-up conduit 63, one of the walls of the internal passage 63*a* in the widthwise direction has an opening through which the medal to be delivered is allowed to pass (63*c*).

The medal counter 64 is made up of: a horizontal rotary shaft 64*a* disposed so as to penetrate the draw-up conduit 63 up to the outer surface thereof in the vicinity of the wall portion on the side opposite to an opening 63*c* of the internal passage 63*a*; a delivery piece 64*b* formed together with the horizontal shaft 64*a* and extending toward the interior of the internal passage 63*a*; a detection piece 64*c* formed together with the horizontal shaft 64*a* outside of the draw-up conduit 63 and extending in parallel with the outer surface of the draw-up conduit 63; a roller 64*d* rotatably mounted on the tip of the delivery piece 64*b*; a spring 64*e* that rotatingly urges the delivery piece 64*b* counterclockwise in FIG. 4; and a photo interpreter 64*f* fixed onto the outer surface of the draw-up conduit 63 for detecting the passing of detection piece 64*c*.

In the medal counter 64 thus organized, the medal lifting within the internal passage 63*a* pushes up the roller 64*d* of the delivery piece 64*b* at side surface thereof against the urging force of the spring 64*e* (rotate clockwise in the surface of FIG. 4). Then, the detection piece 64*c* that rotates together with the delivery piece 64*b* enters the photo interpreter 64*f* immediately before the medal reaches the opening 63*c*. Then, when the medal reaches the opening 63*c*, the delivery piece 64*b* urged by the spring 64*e* allows the medal to be delivered from the opening 63*c* toward the side. With the delivery of the medal, the roller 64*d* of the delivery piece 64*b* is abutted against the side surface of the next medal, the detection piece 64*c* goes out of the photo interpreter 64*f*. In this manner, the medal is delivered toward the side, the number of medals as delivered is counted on the basis of a signal outputted from the photo-interpreter 64*f*.

A guide member 65 that guides the medal delivered through the opening 63*c* to a funnel 17 is fixed to the side of the tip of the draw-up conduit 63 where the opening 63*c* is formed. It should be noted that a guide groove 65*a* formed on the upper surface of the guide member 65 for guiding the medal is formed obliquely with respect to the longitudinal direction of the section of the internal passage 63*a* since the position of the internal passage 63*a* of the draw-up conduit 63 offsets to the position of the funnel 17. Also, the depth of the guide groove 65*a* is deeper at the side of the funnel 17 in such a manner that the medal rolls toward the funnel 17 in the interior of the guide groove 65*a*.

On the front side (the side of the rear plate 6) from the guide member 65, a guide frame 66 which is rectangular viewed from the upper is fixedly hung from the ceiling of the game playing section 2 in such a manner that the longitudinal direction of the guide frame 66 is horizontally in parallel with the rear plate 6. A ball screw 68 which is rotatably driven by a funnel drive motor 70 mounted on the outer surface of the wall 66*a* is put across two walls 66*a* forming the short sides of the guide frame 66. Also, two slide shafts 67 are put thereacross on both sides of the ball screw 68 in parallel with the ball screw 68.

A slider 69 shown in FIG. 9 has two through-holes 69*a* into which the slide shafts 67 are inserted, respectively, and a ball nut 69*b* screwed with the ball screw 68. Hence, upon allowing the funnel drive motor 70 to rotate the ball screw 68, the slider 69 the rotation of which is regulated by the slide shafts 67 moves forward and backward in the axial direction of the slide shafts 67 by the screw movement between the ball screw 68 and the ball nut 69*b*.

The slider 69 hangs and holds the funnel 17 for receiving the medal that has rolled out from the guide member 65. Hence, the funnel 17 is movable selectively to positions A, B and C shown in FIG. 4 with the forward and backward movement of the slider 69.

It should be noted that the position B is positioned in the center line 1 of the medal game machine. The funnel 17 has a lateral symmetric shape, and is structured so that the medal received by a receive inlet opened at its upper end is allowed to fall through a discharge outlet formed in the center of its bottom surface.

As shown in FIG. 4, a first gutter 19 that receives only the medals that fall from the funnel 17 located at the position B and guides the medals, is fitted to the upper portion of the mounting position of the base shaft 30 is the reinforcement plate 27. The first gutter 19 is U-shaped in section which is bent in the form of a mountain so as to be laterally symmetrical with respect to the center line 1 of the medal game machine. Hence, the medal that falls from the funnel 17 located at the position B can be allowed to slidably fall (be guided) into the right and left gutters at the same probability.

Moreover, a right second gutter 18*a* that receives only the medals that fall from the funnel 17 located at the position C and guides the metals, is fitted to the left and upper side of the first gutter 19 viewed from the back surface shown in FIG. 4. Similarly, a left second gutter 18*b* that receives only the medals that fall from the funnel 17 located at the position A and guides the medals, is fitted to the right and upper side of the first gutter 19 viewed from the back surface shown in FIG. 4. Those right and left second gutters 18*a* and 18*b* are fitted to those positions respectively so as to be laterally symmetric with respect to the center line 1 of the medal game machine in the form of a mountain. However, in order to guide the medals that fall from the funnel 17 located at the position B to the first gutter 19, a distance between the right second gutter 18*a* and the left second gutter 18*b* is longer than the width of the discharge outlet of the funnel 17. Also, a protection wall 71 is formed at the upper ends of the respective second gutters 18*a* and 18*b* so that the medal that falls from the funnel 17 located at the position B is prevented from entering those second gutters 18*a* and 18*b*.

Then, the each medal guided by the respective second gutters 18*a* and 18*b* passes through two through-holes D defined on both sides of the rear plate 6, respectively, and is then delivered to the game field. Likewise, the medal guided by the respective first gutters 19 passes through two through-holes E aligned on the lower side of the respective through-holes D, respectively, and is then delivered to the game field.

Figure 3:
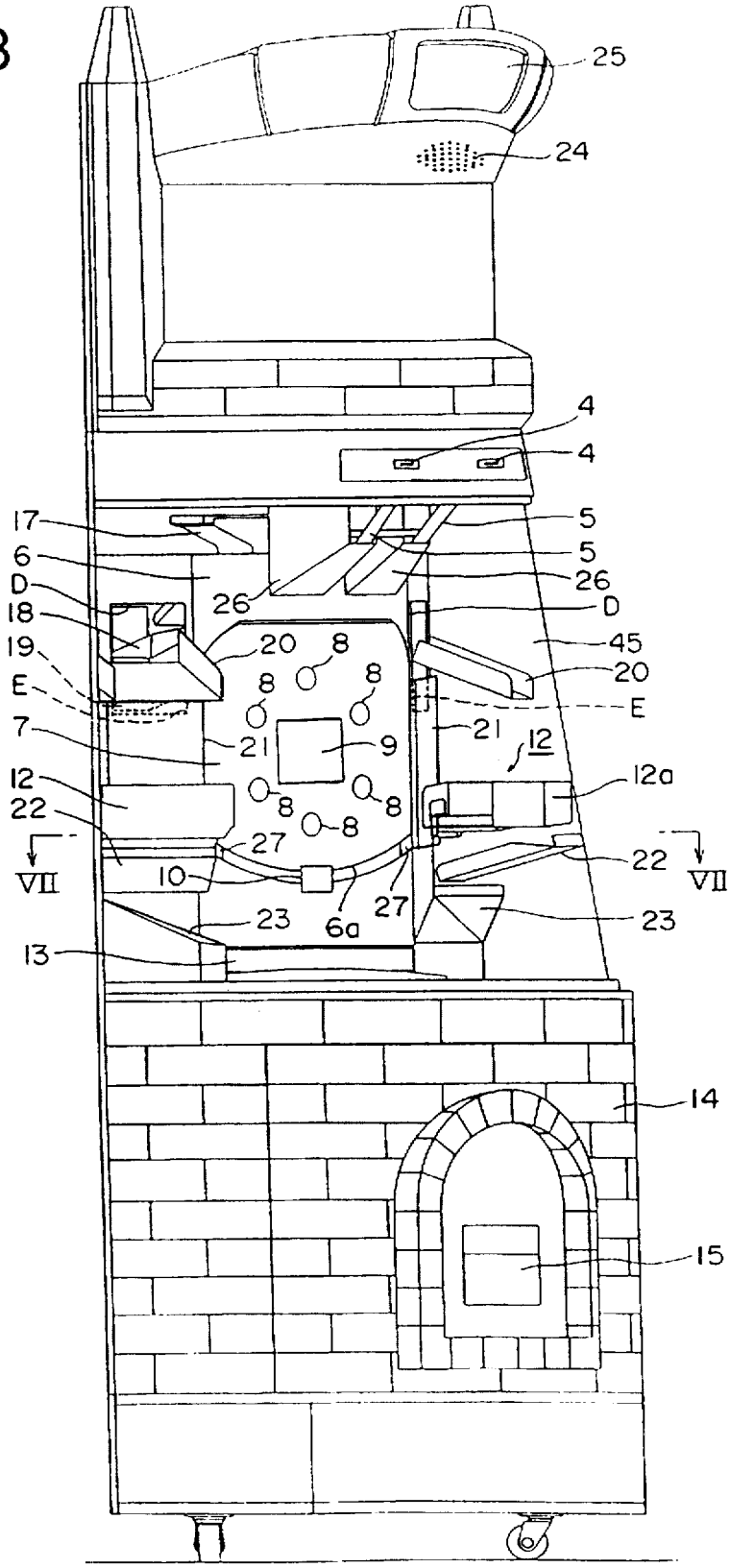
FIG. 3 is a perspective view showing a state in which a cover is detached from the medal game machine of FIG. 1.

As shown in FIG. 3, two first chutes 20 fitted with an inclination that each tip side thereof is lower in level than the base end side, extend from the lower ends of the respective through-holes D in the game field. The shape of the first shooters 20 is U-shaped in section as in the above-mentioned gutters 18 and 19, thus preventing the falling off of the medal from the each side edge of the chutes 20.

The upper portion of the cover 11 shown in FIG. 1 regulates the fall direction of the medal that falls from the first chutes 20 only vertically. A medal discharge unit 12 which is capable of storing the medals that fall from the respective chutes 20 and discharging those medals at one time is disposed on the lower portion of the tip of the respective first chutes 20 so as to be supported by the side walls 45. Hence, all the medals that have fallen from the first chutes 20 enter the vessel of the respective medal discharge unit 12.

Figure 10:
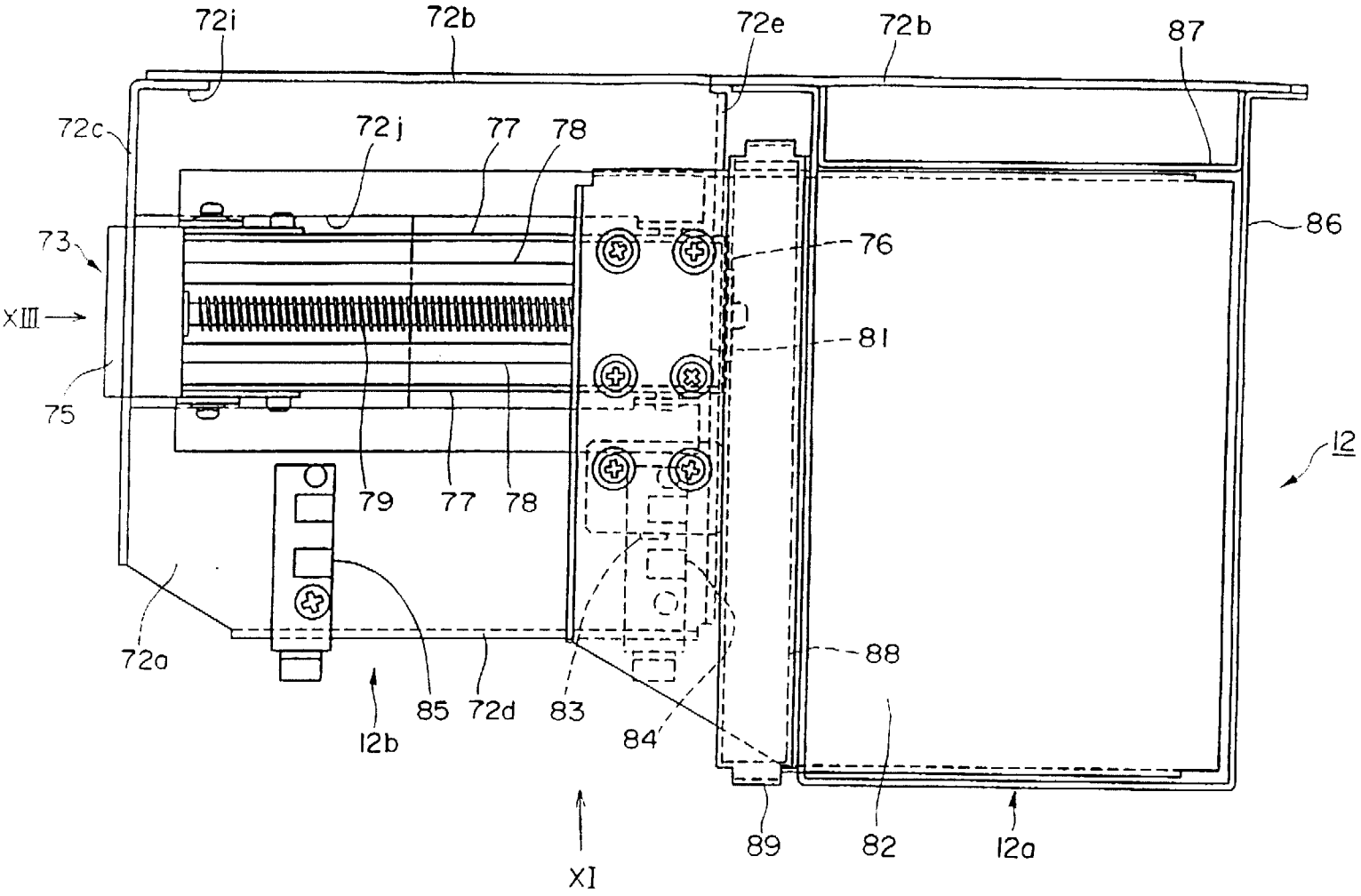
FIG. 10 is a top view showing a medal discharge unit.
Figure 11:
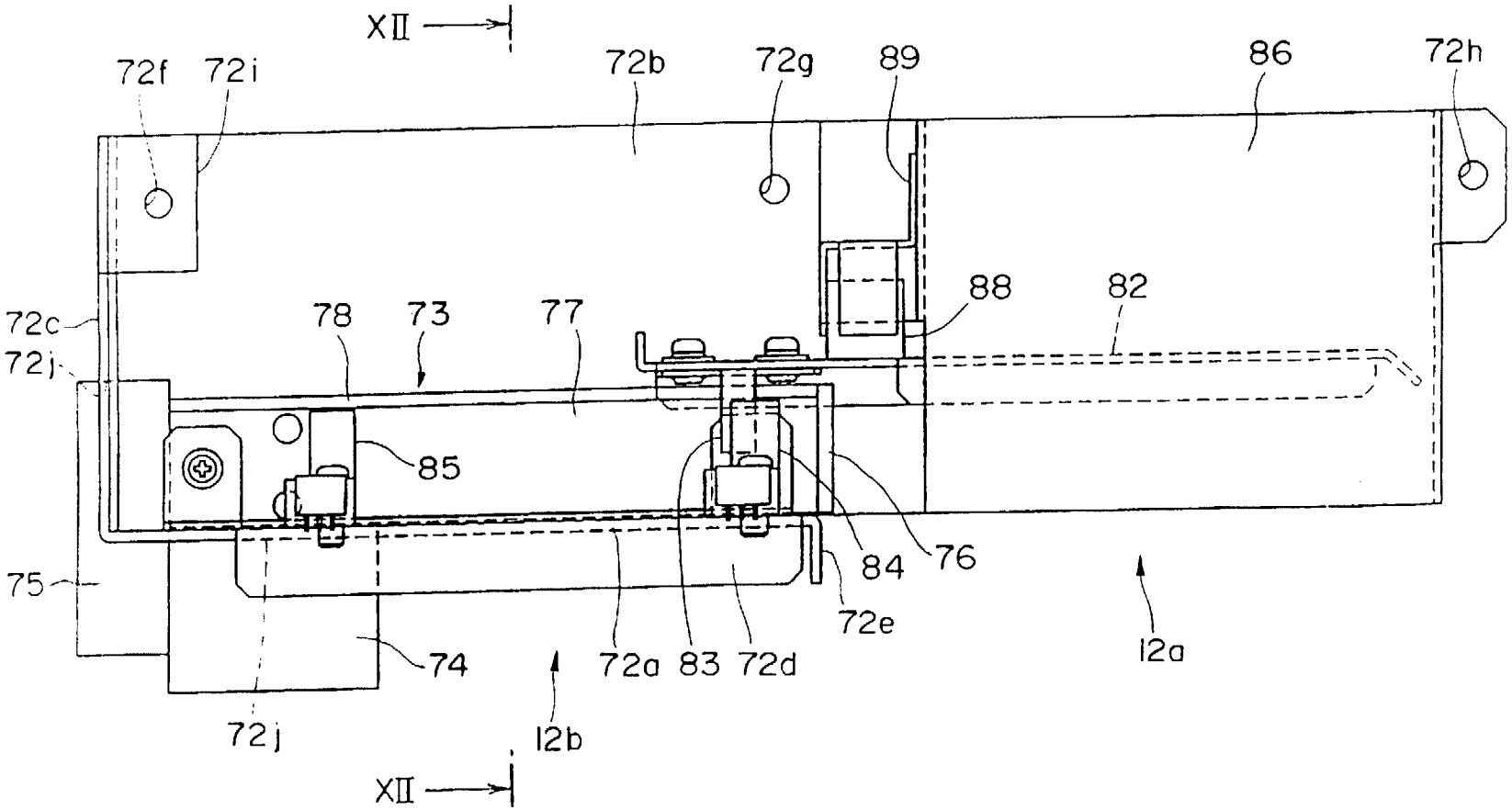
FIG. 11 is a side view showing the medal discharge unit viewed from an arrow XI of FIG. 10.
Figure 12:
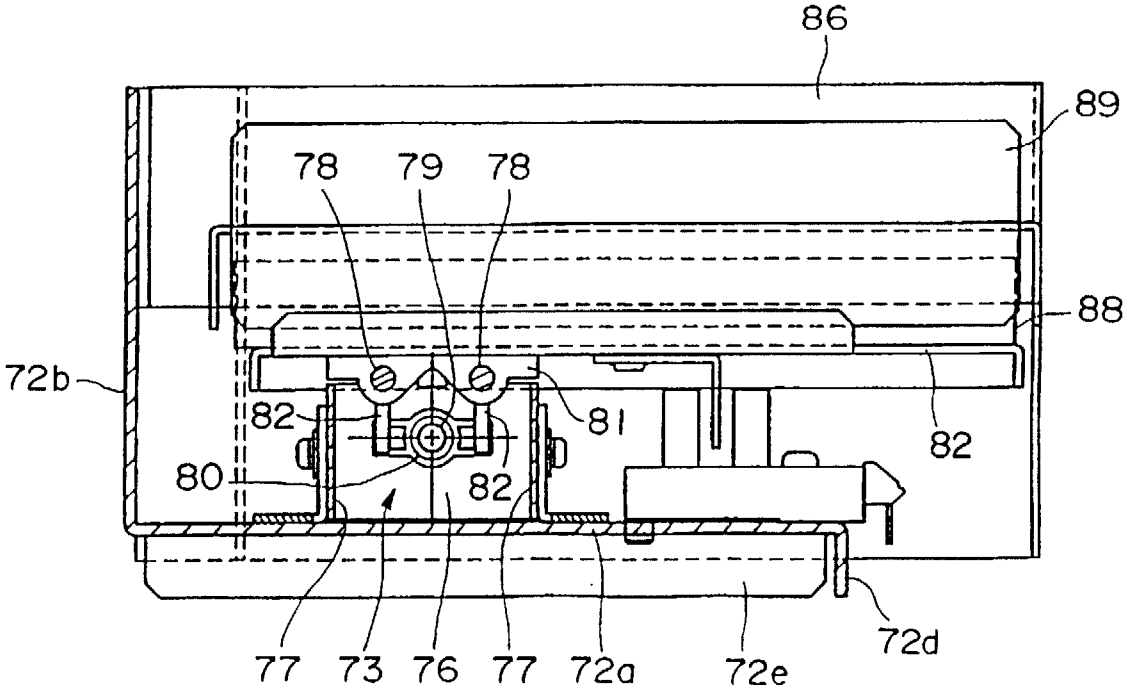
FIG. 12 is a cross-sectional view showing the medal discharge unit along a line XII—XII of FIG. 11.
Figure 13:
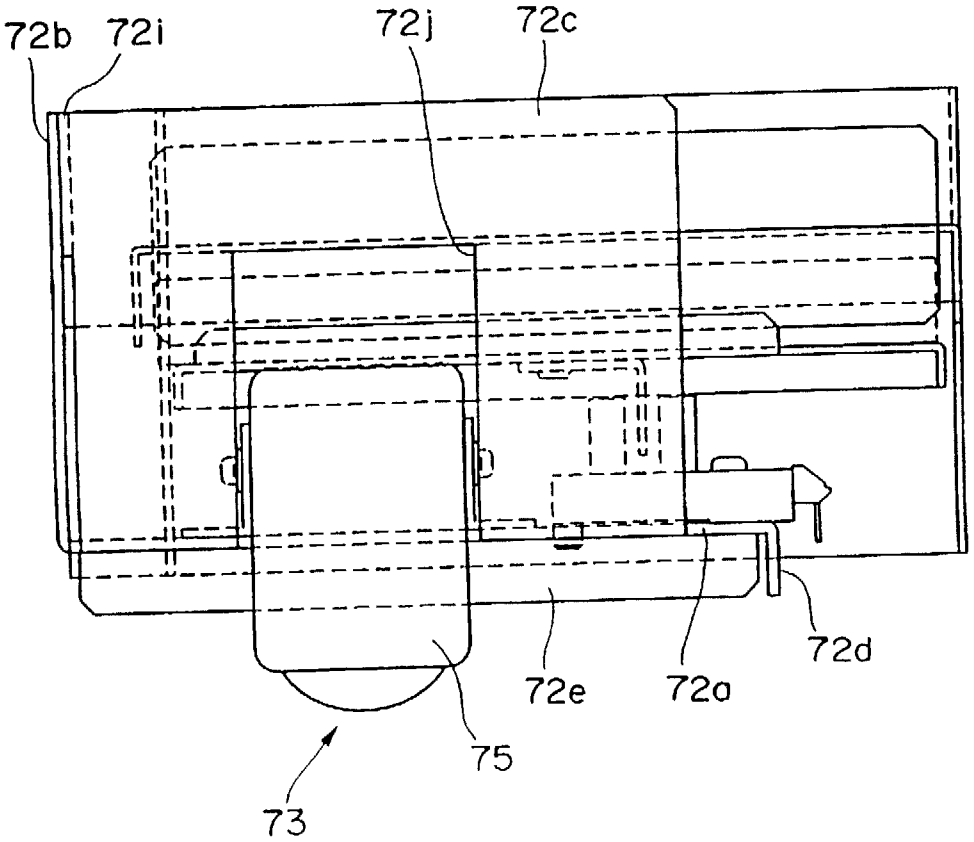
FIG. 13 is a side view showing the medal discharge unit viewed from an arrow XIII of FIG. 10.

The description will be given in more detail of the medal discharge unit 12 with reference to FIGS. 10 to 13. FIG. 10 is a plan view showing a state of the medal discharge unit 12 viewed from the upper. Also, FIG. 11 is a perspective side view showing a state of the medal discharge unit 12 viewed from an arrow XI of FIG. 10. FIG. 12 is a cross-sectional view taken along a line XII—XII of FIG. 11. FIG. 13 is a perspective side view showing a state of the medal discharge unit 121 viewed from an arrow XIII of FIG. 10.

As shown in FIG. 10, the medal discharge unit 12 is roughly made up of a vessel section **12*a* and a drive section 12*b*. As shown in FIG. 11, the drive section 12*b* is disposed on a floor plate 72*a*. The floor plate 72*a* does not extend to the vessel section 12*a* for the reason that the vessel section 12*a*** discharges the medals from its bottom surface.

The edge of the floor plate **72*a* at the side of the side wall 45 is bent upward at a right angle, and forms a mount plate 72*b* for mounting the medal discharge unit 12 to the side wall 45. Since the mount plate 72*b* also has a function of holding the vessel section 12*a*, it extends up to the back of the vessel section 12*a*. Then, fixed holes 72*h*, 72*f* and 72*g* through which screws for fixing the mount section 72*b* to the side wall 45 are inserted are defined in the respective end portions of the mount section 72*b* at the side of the vessel section 12*a*, at the opposite side to the section 12*a*, and at the intermediate portion of the mount plate 72*b***.

Similarly, the end edge of the floor plate **72*a* at the side opposite to the vessel section 12*a* is bent upward at a right angle, thereby forming a reinforcement plate 72*c* for holding an angle (right angle) between the floor plate 72*a* and the mount plate 72*b*. The side edge of the reinforcement plate 72*c* at the side of the mount plate 72*b* is bent at a right angle at the side of the mount plate 72*b*, thereby projecting a screw base section 72*i* which is superimposed on the fixed hole 72*f*. The screw base section 72*i* has a fixed hole that coincides with the fixed hole 72*f* of the mount plate 72*b* formed. Hence, a screw is screwed in the respective fixed holes in a state the respective components are superimposed on each other so as to fix them to the wall surface 16, thereby holding an angle (right angle) between the floor plate 72*a* and the mount plate 72*b***.

Also, the other edges **72*d* and 72*e* of the floor plate 72*a* are bent downward at a right angle as ribs for increasing the strength of the floor plate 72*a*, as shown in FIGS. 11 and 12. A rectangularly cut-out opening 72*j* is formed in the nearly center of the floor plate 72*a* in the vicinity of the reinforcement plate 72*c*. The opening 72*j* extends up to the reinforcement plate 72*c* as shown in FIG. 13**.

A slide mechanism 73 is fixed on the floor plate **72*a* from the opening 72*j* toward the vessel section 12*a*. The slide mechanism 73 is made up of a bottom plate drive motor 74, a gear box 75, a bearing plate 76, two frames 77, two slide shafts 78, a ball screw 79, a ball nut 80 and a slider 81**.

The gear box 75 has a reduction gear train that reduces the revolution of the bottom plate drive motor 74 therein and transmits the rotation of the bottom plate drive motor 74 to the ball screw 79. A predetermined interval is fixedly held between the gear box 75 and the bearing plate 76 by the two frames 77 each being formed of an elongated plate. As shown in FIG. 10 and 12, the ball screw 79 is rotatably put across the gear box 75 and the bearing plate 76 in such a manner that it passes through the middle position of the two frames 77. Also, the two slide shafts 78 are put across the gear box 75 and the bearing plate 76 in such a manner that they pass through the right and upper position and the left and upper position of the ball screw 79 in FIG. 12.

The above-mentioned ball screw 79 is screwed with the ball nut 80. Also, both the slide shafts 78 penetrate one slider 81, and the slider 81 is non-rotatable but slidably fitted to the slide shafts 78. Then, the ball nut 80 and the slider 81 are fixed mutually to each other by two connecting pieces 82. Therefore, upon the rotation of the ball screw 79 by the bottom plate drive motor 74, since the ball nut 80 the rotation of which is impeded by the connecting pieces 82 moves forward and backward in the axial direction of the ball screw 79, the slider 81 connected to the ball nut 80 also slides with respect to the slide shafts 78.

The slide mechanism 73 thus organized is fitted onto the floor plate **72*a* in a state where the gear box 75 is fitted into the opening 72*j* of the reinforcement plate 72*c*, and the bottom plate drive motor 74 is fitted into the opening 72*j* of the floor plate 72*a*. The direction of the ball screw 79 and both the slide shafts 78 in the slide mechanism 73 thus fitted, that is, the slide direction of the slider 81 is in parallel with the longitudinal direction of the mount plate 72*b***.

The base portion of the bottom plate 82 is fitted onto the upper surface of the slider 81. The bottom plate 82 is, as shown in FIG. 10, of a substantially rectangular shape where only a corner farthest from the mount plate **72*b* in the base portion is obliquely notched. Then, its tip edge (an edge farthest from the mount position of the slider 81) is bent obliquely downward, the base end edge is bent upward at a right angle as a rib for improving the strength, and other two side edges are bent downward at a right angle as ribs for improving the strength. The bottom plate 82 is made up of a movable bottom plate of the vessel section 12*a*. It should be noted that a light shield plate 83 of a small plate piece is fitted downward in parallel with the slide direction of the bottom plate 82 to the side of the lower surface of the bottom plate 82 where the slider 81 is mounted. Then, a first limit sensor (photo interrupter) 84 that detects the position of the light shield plate 83 is fitted onto the upper surface of the floor plate 72*a* at a position where the bottom plate 82 that most advances to the vessel section 12*a* side. A second limit sensor (photo interrupter) 85 that defines the most retreat position of the bottom plate 82 is fitted onto the upper surface of the floor plate 72*a*. Hence, the bottom plate 82 is reciprocatingly slidable within a range which is between a position where the light shield plate 83 is detected by the limit sensor 84 and another position where the light shield plate 83 is detected by the limit sensor 85**.

On the other hand, two frame plates 86 and 87 as frames of forming a square-shaped vessel by surrounding the bottom plate 82 (except for the notch portion) in most advancing the bottom plate 82 to the vessel section **12*a* side is fitted onto the mount plate 72*b* of the vessel section 12*a*. The frame plates 86 and 87 are structured so that a gap defined between the bottom plate 82 and the frame plates 86, 87 is narrower than the thickness of the medal in a state where the bottom plate 82 is most advanced to the vessel section 12***a* side. Hence, within the vessel thus formed are stored the medals that have slidingly fallen from the first shooter 20. It should be noted that the cover 11 shown in FIG. 1 is opened between the first shooter 20 and the vessel section 12*a*. As a result, the player can observe a state in which the medals slidingly fall from the first shooter 20 and are then stored in the vessel section 12*a*. Also, when the bottom plate 82 retreats to the drive section 12*b* side in a state where the medals are stored in the vessel, the bottom of the vessel is opened, thereby dropping the medals stored in the vessel downward.

By the way, the wall surface of the frame plate 86 at the drive section 12*b* side is notched at the lower portion up to a height where it is slightly apart from the upper surface of the bottom plate 82 so that the wall surface is prevented from interfering with the movement of the bottom plate 82. However, there is the possibility that the medal enters, if the bottom plate 82 and the frame plate 86 are spaced from each other, the gap defined between the bottom plate 82 and the frame plate 86. For that reason, a stopper 88 that prevents the medals from entering the gap by bringing the stopper 88 in close contact with the upper surface of the bottom plate 82 is slidably located on the bottom plate 82 at the outer side of the frame plate 86. The stopper 88 is formed of a plastic rectangular material, and its thickness is larger than the gap between the bottom plate 82 and the frame 86, and its overall length is substantially equal to the width of the bottom plate 82. A stopper cover 89 for preventing the stopper 88 from falling off from the bottom plate 82 is stuck onto the frame plate 86 at the drive section 12*b* side. The stopper cover 89 is formed of a plate having such a shape that a rectangular protrusion piece protrudes from each side of a rectangular plate having an area slightly broader than the upper surface of the stopper 88. The protrusion piece protruding from the longest side is bent upward and stuck onto the outer surface of the frame 86. Also, other three protrusion pieces are bent downward. The stopper 88 is prevented from moving by the three protrusion pieces bent downward and the surface of the frame plate 86 at the drive section 12*b* side. It should be noted that the upper surface of the stopper 88 and the stopper cover 89 are spaced from each other so that the stopper 88 and the bottom plate 82 are prevented from being in contact with each other-by only the self-weight of the stopper 88 causing an excessive friction, to thereby permit a slight quiver of the stopper 88 vertically.

It should be noted that the maximum retreat position of the bottom plate 82 at the drive section 12*b* side is limited to a position where the tip of the bottom plate 82 slightly remains within the frame 86 of the vessel section 12*a* so that the stopper 88 is prevented from falling off in the state where the bottom plate 82 is drawn out from the vessel section 12*a* and the bottom of the vessel section 12*a* is opened. In other words, the second limit sensor 85 is fitted to a position of the lower surface of the bottom plate 12*a* where the light shield plate 83 is detected in this state. Since the tip of the light shield plate 83 thus slightly remaining within the frame of the vessel section 12*a* is inclined downward as described above, the medal is prevented from being caught by the tip of the bottom plate 82.

The medals which have been discharged from the medal discharge units 12 thus organized (which have fallen from the vessel section 12*a*) are guided to the rear plate 6 side once by the second chutes 22 shown in FIG. 3. Since the second chutes 22 are also substantially concave in section as in the first chutes 20, the medals are prevented from falling off from its side edges. Also, since the upper end edges of the second chutes 22 (the edges nearest to the medal discharge mechanisms 12) are bent upward, all the medals that have fallen from the vessel of the medal discharge mechanisms 12 slidingly fall from the chutes 22 without falling from the upper end edges.

Then, the medals that have fallen from the second chutes 22 fall on third chutes 23 which are inclined toward the movable table 13. Therefore, those medals are guided on the upper surface of the movable table 13 by the third chutes 23.

The medal hopper 60, the guide member 65, the funnel 17, the second gutter 18, the first chute 20, the medal discharge unit 12, the second chute 22 and the third chute 23 as described above constitute first supply mechanism. Also, the medal hopper 60, the guide member 65, the funnel 17, the second gutter 18 and the first chute 20 constitute medal increasing mechanism.

On the other hand, the medals that have passed through the two through-holes E and have been fed to the game field side fall on the third chutes directly from the through-holes E, and are then supplied onto the movable table 13. It should be noted that there is disposed on the rear plate 6 medal fly-out preventing covers 21 for ensuring the medal fall passages from the outlets of the respective holes E to the third chutes 23, and for preventing medals from flying out, so that the medals falling from the through-holes E are prevented from flying out to cause the medals, for example, to enter the drive section 12*b* of the medal discharge units 12. In other words, the medal hopper 60, the guide member 65, the funnel 17, the first gutter 19, the medal fly-out preventing covers 21 and the third chute 23 as described above constitute second supply mechanism and third supply mechanism.

(Control Mechanism)

Figure 14:
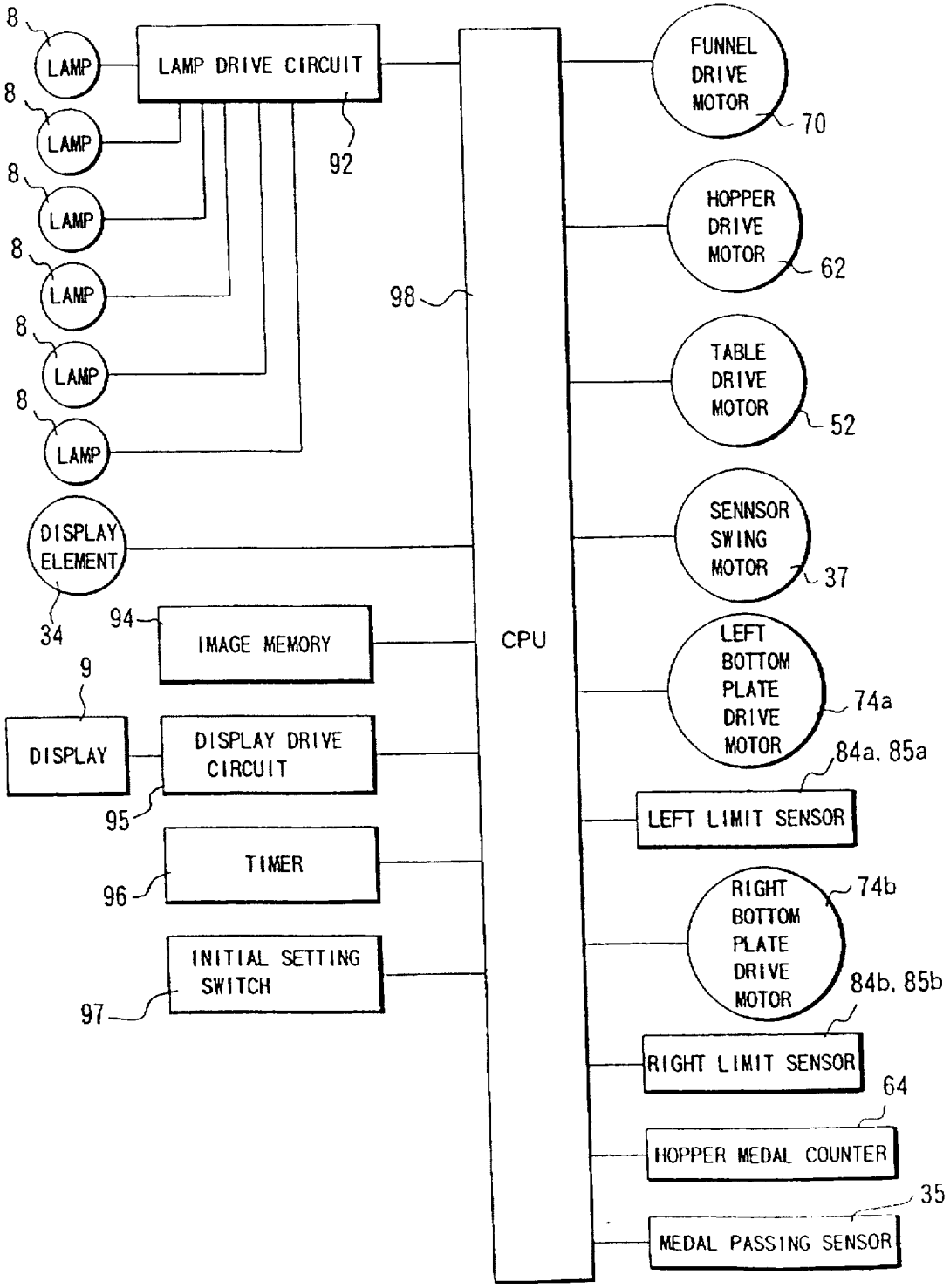
FIG. 14 is a block diagram showing an internal circuit of the medal game machine of FIG. 1.

Subsequently, a circuit structure for controlling the operation of the above-mentioned respective motors, etc., will be described with reference to the block diagram shown in FIG. 14. In FIG. 14, there are connected to a CPU 98, the funnel drive motor 70, the hopper drive motor 62, the table drive motor 52, the sensor swing motor 37, the left bottom plate drive motor 74*af*, the left limit sensors 84*a* and 85*a*, the right bottom plate drive motor 74*b*, the right limit sensors 84*b* and 85*b*, the hopper medal counter 64, the medal passing sensor (a light receiving element) 35 and the display element 34. The CPU 98 stands for a central processing unit that performs the control of the whole medal game machine, which forms a part of the first supply mechanism, the medal increasing mechanism, the second supply mechanism, the third supply mechanism and the electing mechanism. Also, the left bottom plate drive motor 74*a* which is a bottom plate drive motor 74 assembled into the medal discharge unit 12 positioned at the left side viewed from the front, and the left limit sensors 84*a* and 85*a* which are the limit sensors 84 and 85 respectively which are assembled into the medal discharge unit 12 positioned at the left side. Similarly, the right bottom plate drive motor 74*b* which is the bottom plate drive motor 74 assembled into the medal discharge unit 12 positioned at the right side viewed from the front, and the right limit sensors 84*b* and 85*b* which are the limit sensors 84 and 85 respectively which are assembled into the medal discharge unit 12 positioned at the right side.

The CPU 98 is connected with a lamp drive circuit 92, an image memory 94, a display drive circuit 95, a timer 96 and an initial setting switch 97. The lamp drive circuit 92 is a circuit for turning on/off six lamps 8 in accordance with the control from the CPU 98, respectively.

The display drive circuit 95 is a drive circuit that displays an image on the display 9 in accordance with the control from the CPU 98.

Figure 17A:
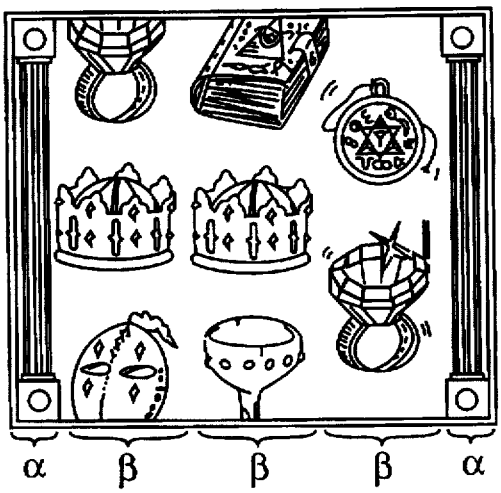
FIGS. 17A and 17B are diagrams showing a screen which is displayed on a display.
Figure 17B:
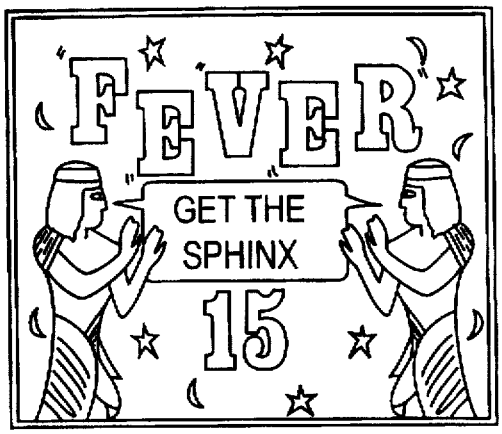

The image memory 94 is a memory for storing image data to be displayed on the display 94 therein. An example of the image data stored in the image memory 94 is shown in FIGS. 17A and 17B. FIG. 17A shows an image in a normal screen which is representative of the drum of a slot machine. The interior of the image is divided into two outer frame portions a and vertically three-divided drum portions β. Upon the detection of the passing of the medal by the medal passing sensor 35, the slot game is then executed by the drum portions β. In other words, the respective symbols shown in FIG. 18 are moved from the upper to the lower in a predetermined order for each drum portion β, and their movements are then stopped at a predetermined timing. As a result, it looks as if the drum of the slot machine is rotated. It should be noted that the arrangement of the symbols at the time of a stoppage is at random as in the event of the slot machine. It should be noted that the circles indicated at four corners of the outer frame represent the number of times of the slot games to be executed. Also, the direction of movement of each symbol in the respective drum portions β may be directed from the lower toward the upper, or the direction thereof may be different for each of the drum portions β. On the other hand, FIG. 17B shows the image of an screen which is displayed for 15 seconds when three characters of the same pattern become uniform as a result of the slot game.

The timer 96 is made up of a circuit that supplies time information to the CPU 98.

The initial setting switch 97 is made up of a switch disposed at a position where the employee of the amusement arcade can only operate the switch, such as the interior of the cover 93 of the medal collect section 3, which is provided to set the medal game machine to a game startable state.

(Control Processing)

Figure 15:
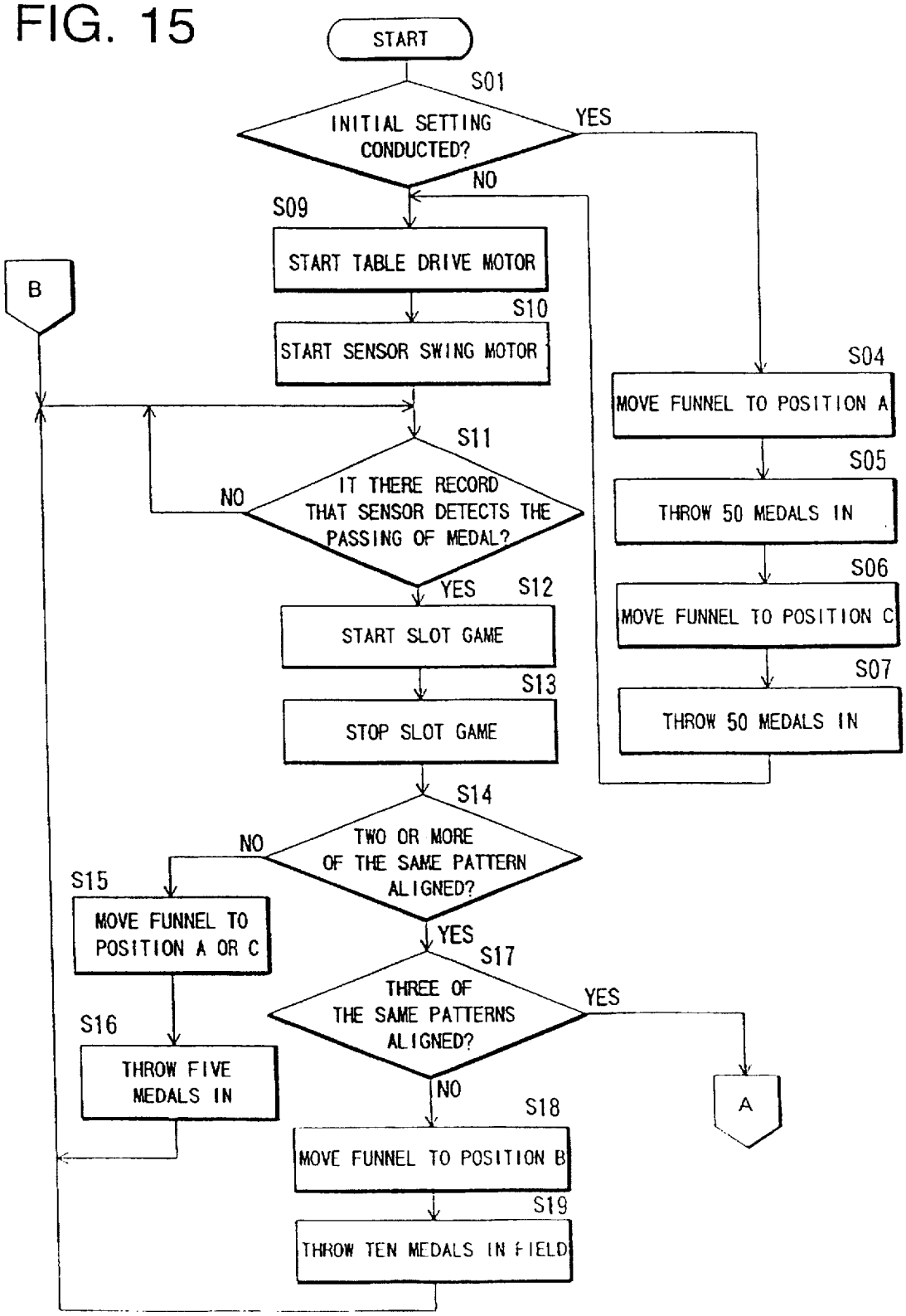
FIG. 15 is a flowchart showing the contents of a control processing which is executed in a CPU of FIG. 14.

Next, the control processing to be executed in the CPU 98 of FIG. 14 will be described with reference to the flowcharts shown in FIGS. 15 and 16.

The control processing starts upon turning on a main power source for the medal game machine. Then, initially in step S01, it is judged whether an initial setting is conducted or not. This judgement is conducted in accordance with the state of the initial setting switch 97. Then, in the case where the initial setting is not conducted (that is, in the case where the power source is turned on twice or more after the medal game machine is operated) the processing is advanced to step S09 as it is.

On the contrary, in the case of conducting the initial setting (that is, in the case of turning of the power source initially after the medal game machine is operated), the funnel 17 is moved to the position A (Step S04) and 50 medals are thrown in (Step S05). As a result, 50 medals are stored in the vessel of the medal discharge unit 12 at the left side viewed from the front. Then, in the same manner, the funnel 17 is moved to the position C (step S06), and 50 medals are thrown in (step S07). As a result, 50 medals are stored in the vessel of the medal discharge unit 12 at the right side viewed from the front. Upon the completion of the initial setting, the processing is advanced to step S09.

In step S09, the rotation of the table drive motor 62 is started. As a result, the slide table 13 slides on the fixed table 14 while it repeatedly advances toward the front side and retreats toward the rear side.

Subsequently, in step S10, the rotation of the sensor swing motor 37 is started. As a result, the medal detection section 10 swings on the rear plate 6.

Then, in step S11, it is checked whether there is a record that the medal passing sensor 35 detects the passing of the medal, or not. This record is conducted as a numerical value which is increased every time the medal passing sensor 35 detects the passing of the medal. It should be noted that the circles at the four corners of the outer frames α displayed on the display device 9 change from white to black by only the number identical with the identical value recorded. Then, if there is no record that the passing of the medal is detected, the checking process in step S11 is repeated. On the contrary, if there is the record (that is, in the case where the third condition is satisfied), the numerical value recorded is decrease by one, and then processing is advanced to step S12.

In step S12, the slot game is started as electing mechanism for conducting the selection of the prize. In other words, the symbols of the respective drum portions β in the slot screen (FIG. 17A) displayed on the display device 9 are moved continuously from the upper to the lower. Then, in step S13, the patterns moving on the respective drum portions β are sequentially suspended.

Next, in step S14, the symbols aligned in the middle line on the slot screen are checked, and it is judged whether the same pattern are aligned two or more, or not. Then, in the case where the same pattern is not aligned at all, as the second condition is satisfied, the processing is advanced to step S15. In step S15, the funnel drive motor 70 is driven to move the funnel 17 to the positions A or C (if the current position is A, then the funnel 17 is moved to the position C; if the current position is C, then the funnel 17 is moved to the position A; and if the current position is B, then the funnel 17 is moved to a position opposite to the position before moving to the current position). Then, in step S16, five medals are thrown in (corresponding to medal increasing mechanism). As a result, the medals within the vessel at the right or left medal discharge section 12 are increased in number. Hence, the expected value of the number of the refundable medals is increased per one thrown-in medal. It should be noted that, since the position of the funnel 17 is alternately moved to the positions A and C in step S15, the number of medals within the vessels at both the medal discharge sections 12 are made substantially identical with each other. With the above processing, the event of the slot game at this time is finished, and therefore the processing is returned to step S11 for preparing for the next slot game.

On the contrary, in the case where two or more of the patterns are aligned, it is checked in step S17 whether three of the same pattern are aligned or not. The case where three of the same pattern are not aligned is a case in which only two of the same pattern are aligned and the second prize is elected. The second prize is selected with the probability higher than the case where three of the same pattern are aligned. Then, in step S18, the funnel drive motor 70 is so driven as to move the funnel 17 to the position B. In step S19, ten medals are thrown in (corresponding to second supply mechanism). As a result, since ten medals are supplied onto the slide table 13, it can be expected that a large number of medals fall in the medal fall hole 14*a*. With the above processing, since the event of the slot game at this time is finished, the processing is returned to step S11 for preparing for the next slot game.

On the contrary, the case where three of the same pattern are aligned in step S17 means a case in which the first prize is elected. In step S20, the lamp 8 corresponding to the aligned patterns is turned on. Subsequently, it is judged in step S21 whether all six lamps are aligned or not (whether all the patterns are aligned three by three, or not).

Then, in the case where all the lamps are not yet turned on, the funnel drive motor 70 is so driven as to move the funnel 17 to the position B in step S22. Thereafter, in step S23, the timer 96 is started and the image shown in FIG. 17B is displayed on the display device 9, and the processing is advanced to step S24 in which it is checked whether 15 seconds elapsed after the timer starts or not. Then, if 15 seconds do not yet elapse after the timer is started, it is then checked in step S25 whether the medal passing sensor 35 detects the passing of the medal or not. If the medal passing sensor 35 does not detect the medal, then the processing is returned to step S24 as it is, whereas if the medal passing sensor 35 detects the medal, then the processing is returned to step S24 after ten medals are thrown in step S26. The above-mentioned processing is repeated until it is judged that 15 seconds elapse after the timer is started in step S24 (corresponding to third supply mechanism). As a result, since a large number of medals are supplied onto the slide table 13, it can be expected that a large number of medals fall into the medal fall hole 14*a*. With the above operation, since the event of the slot game at this time is finished, the processing is returned to step S11 for preparing for the next slot game.

On the contrary, in the case where it is judged in step S21 that all the lamps 8 are turned on (that is, in the case where the first condition is satisfied), the left bottom plate drive motor 74*a* and the right bottom plate drive motor 74*b* are driven in step S27, to thereby release the bottom plates 82 of the vessel of the right and left medal discharge units 12 (corresponding to first supply mechanism). As a result, a large number (100 pieces or more) of medals stored in the vessels at the respective medal discharge units 12 up to the time are discharged onto the game field at one time, thereby being capable of expecting that a large number of medals fall from the medal fall hole 14*a*. Thereafter, the left bottom plate drive motor 74*a* and the right bottom plate drive motor 74*b* are reversely driven, thereby closing the bottom plates 82 of the vessels at the right and left medal discharge units 12 (step S28). Then, the funnel 17 is moved to the position A (step S29), and 50 medals are thrown in (step S30). As a result, 50 medals are stored within the vessel of the left medal discharge unit 12 viewed from the front. Then, in the same manner, the funnel 17 is moved to the position C (step S31), and 50 medals are thrown in (step S32). As a result, 50 medals are stored within the vessel of the right medal discharge unit 12 viewed from the front, similarly. Finally, all the lamps 8 are turned off. With the above processing, since the event of the slot game at this time is finished, the processing is returned to step S11 for preparing for the next slot game.

(Operation of the Embodiment)

Subsequently, the operation of the medal game machine thus organized will be described. First, upon turning on the main power source by the operator of this medal game machine, it is judged whether the initial setting is conducted or not. Then, upon turning on the initial setting switch 97 by the operator, the advance and retreat of the slide table 12 and the swing of the medal detection section 10 are started.

In this situation, if the player inserts in the medals from the medal insert slot 4, then the medals are introduced into the gap between the rear plate 6 and the guide plate 7 through the guide 5 and the slide 26. The medals introduced into the gap between the rear plate 6 and the guide plate 7 fall while the fall locus thereof is changed at random by a large number of pins 28, thereby falling at any position on the slide table 13. Then, the medals falls off on the upper surface of the slide table 13 with the advance of the slide table 13 toward the front side, and are pushed out relatively toward the tip side of the slide table 13 by the wiper member 43 with the retreat of the slide table 13 toward the rear plate 6. Upon the pushing out of the medals, other medals are also pushed out together. Then, if the deposition of the medals on the slide table 13 is sparse, then the gaps between the respective medals are merely made dense so that the movement of pushing out of the medals is absorbed, whereby any medal does not fall from the slide table 13. However, if the deposition of the medals on the slide table 13 is dense, the movement of pushing out of the medals is transmitted to the medals which are situated on the front end of the slit table, with the result that one or a plurality of medals fall to the fixed table 14.

The medals that have fallen onto the fixed table 14 are pushed out by the wiper member 55 of the tip of the slide table 13. As a result, any medals may fall from the fixed table 14 as in the slide table 13. If the medal falls into the medal pitfall 14*a*, then the player can take out the medal from the refundment outlet 15. However, if the medal falls into the medal collect hole 14*b*, the medal enters the medal stock box 59 so that the player cannot take out the medal.

During repeating the throw-in operation of the medal, there is a case where the medal that has fallen in the gap between the rear plate 6 and the guide plate 7 passes through a gap between the support members 32 that support the medal detection section 10. In this case, the slot game is executed on the display device 9. Then, when the patterns are not identical with each other at all, five medals drawn-up by the medal hopper from the medal stock box 59 are additionally thrown within the vessel section 12*a* of the medal discharge section 12 through the funnel 17, the second gutter 18, the through-hole D and the first chute 20. In this way, even in the case where no prize is won at all by the slot game, the number of medals within the vessel section 12*a* of the medal discharge section 12 is increased, thereby increasing the number of the discharge medals when the lamps are aligned. In other words, the expected value of the number of the refundable medals per one thrown-in medal becomes increased bit by bit. Hence, the player could not suspend the game more as the game is advanced.

Also, when two of the same pattern are aligned in the slot game, the medal drawn up from the medal stock box 59 by the medal hopper is thrown in the game field through the funnel 17, the first gutter 19, the through-hole E, the metal fly-out preventing cover 21 and the third chute 23. In this case, no medal is thrown in the vessel section 12*a* of the medal discharge section 12. However, since the probability that the medals stored within the vessel section 12*a* are discharged is remarkably low, a given number of medals are thrown in the game field for each event which is high in the probability of occurrence. As a result, the speculative spirit of the player can be maintained.

Also, when three of the same pattern are aligned by the slot game, then the game becomes in a "fever" state. In the "fever" state, 10 medals are supplied to the game field every time the medal passes between the two support members 32. In this manner, when there occurs the event which is lower in probability than that in which two of the same pattern are aligned, a large number of metals more than the case where two of the same pattern are aligned are thrown in the game field, thereby rewarding the player for his effort, with the result that the player can continue the game.

It should be noted that when three of the same pattern is aligned, the lamp 8 corresponding to the pattern is turned on. When all the lamps are turned on, since a large number of medals are discharged from the medal discharge section 12, the expected value of the number of the refundable medals per one thrown-in medal is remarkably increased. Hence, the speculative spirit of the player is more excited, thereby being capable of maintaining the game.

In this way, when all the six lamps 8 are turned on, the bottom plate 82 of the vessel section 12*a* of the medal discharge section 12 is opened so that a large number of medals stored in the vessel are discharged with the game field through the second chute 22 and the third chute 23. In this situation, as described above, as the number of times where the same pattern is not aligned at all is increased, the number of discharged medals are increased more. As a result, as the game is advanced, the number of the refundable medals is increased more, thereby being capable of making the player hesitate the suspension of the game.

As described above, the amusingness of the metal game machine in accordance with this embodiment is improved more than the conventional one.

According to the medal game machine of the present invention as described above, the expected value of the number of the refundable medals per one medal inserted by the player can be gradually increased. In particular, according to the medal game machine of the first aspect of the present invention, since the medals can be stacked on the table by supplying a number of the medals at one time, the player can expect that a large number of medals may be paid back. Also, according to the medal game machine of the second aspect of the present invention, in the case where the election of the prize is in failure, the number of medals to be supplemented onto the table when the prize is elected is increased, to thereby reward the player for his effort, with the result of being capable of keeping the player having a desire to continue the game even though the election of the prize is in failure.

This invention being thus described, it will be obvious that same may be varied in same way. Such variation are not be regarded as a departure from the spirit and scope of the invention, and all such modification as would be obvious one skilled in the art intended to be included within the scope of the following claims.

What is claimed is:

1. A medal game machine, comprising:

a table having an upper surface on which medals are located;

a medal pushing member slidably movable relative to and along said upper surface of said table to push the medals located on said upper surface of said table toward an edge of said upper surface of the said table;

a medal pushing member slidably movable relative to and along said upper surface of said table to push the medals located on said upper surface of said table toward an edge of said upper surface of the said table;

a guide which guides medals to said upper surface of said table according to an operation by a player;

a vessel including a sidewall member surrounding a space in which medals can be accommodated, said sidewall member having a lower opening through which medals can be accommodated in said space are discharged, and a bottom plate movable between a first position in which said bottom plate closes said lower opening of said sidewall member and second position in which said bottom plate opens said lower opening of said sidewall member; and a first supply mechanism which transfers medals accommodated in said vessel to said upper surface of said table by moving said bottom plate from said first position to said second position when a first condition is satisfied.

2. A medal game machine as claimed in claim 1, further comprising:

an electing mechanism which elects prizes when a second condition is satisfied.

3. A medal game machine as claimed in claim 2, wherein said first condition is that a first prize is elected a predetermined number of times by said electing mechanism.

4. A medal game machine as claimed in claim 3, further comprising:

a medal casting mechanism which casts a predetermined number of medals into said vessel when said electing mechanism is activated and said second condition is not satisfied.

5. A medal game machine as claimed in claim 3, further comprising:

a second supply mechanism for supplying a predetermined number of medals to the upper surface of said table, when a second prize, which has a higher probability of being elected than said first prize, is elected by said electing mechanism.

6. A medal game machine as claimed in claim 5, wherein said medal casting mechanism comprises a first inclined conduit having an upper end to catch a falling medal and to guide the medal to said vessel through said first inclined conduit, and wherein said second supply mechanism has a second inclined conduit having an upper end to catch the falling medal and guiding the medal to said upper surface of said table through said second inclined conduit, said medal game machine further comprising a hopper movable in a substantially horizontal direction between at least a first position, where said medal dropped from said hopper falls into said upper end of said first inclined conduit, and a second position where said medal dropped from said hopper falls into said upper end of said second inclined conduit.

7. A medal game machine as claimed in claim 2, wherein said guide comprises a plurality of passages, said guide randomly guides said medals via one of said plurality of passages;

said medal game machine further comprising a detection mechanism that detects a medal at any position of said plurality of passages to satisfy said second condition.

8. A medal game machine as claimed in claim 7, further comprising a third supply mechanism for supplying a predetermined number of medals onto said upper surface of said table each time a medal is detected by said detection mechanism during a predetermined period of time after said first prize is elected by said electing mechanism.

9. A medal game machine as claimed in claim 7, wherein said detection mechanism moves between said plurality of passages within said guide.

10. A medal game machine as claimed in claim 7, wherein said guide further comprises a plurality of protrusions that collide with said medals, randomizing a travel path of said medals.

* * * * *

UNITED STATES PATENT AND TRADEMARK OFFICE

CERTIFICATE OF CORRECTION

PATENT NO. : 5,775,691

DATED : July 7, 1998

INVENTOR(S) : Takashi HAMANO

It is certified that error appears in the above-identified patent and that said Letters Patent is hereby corrected as shown below:

Column 21, lines 49-52 (claim 1, lines 8-11) of the printed patent, should be deleted.

Signed and Sealed this

Twenty-first Day of March, 2000

*Attest:*

*Attesting Officer*

Q. TODD DICKINSON

*Commissioner of Patents and Trademarks*

US005775691B1

REEXAMINATION CERTIFICATE (4006th)

United States Patent [19] [11] B1 5,775,691

Hamano [45] Certificate Issued Feb. 29, 2000

[54] MEDAL GAME MACHINE

[75] Inventor: Takashi Hamano, Kawasaki, Japan

[73] Assignee: Konami Co., Ltd., Kawasaki, Japan

Reexamination Request:
No. 90/005,253, Mar. 15, 1999

Reexamination Certificate for:

| | |
|---|---|
| Patent No.: | **5,775,691** |
| Issued: | **Jul. 7, 1998** |
| Appl. No.: | **08/856,177** |
| Filed: | **May 14, 1997** |

Related U.S. Application Data

[63] Continuation of application No. 08/693,636, Aug. 9, 1996.

[30] Foreign Application Priority Data

Aug. 11, 1995 [JP] Japan ..... 7-205746

[51] Int. Cl.[7] ..... A63F 7/02

[52] U.S. Cl. ..... 273/138.2; 273/454; 273/138.3

[58] Field of Search ..... 273/138.1, 138.2, 273/138.3, 138.4, 138.5, 441, 459, 454; 453/1, 2, 18, 29, 58; 194/202, 215

[56] References Cited

FOREIGN PATENT DOCUMENTS 7701197 9/1977 Netherlands .

*Primary Examiner*—William M. Pierce

[57] ABSTRACT

A medal inserted from an insert slot is guided by a gap between a rear plate and a cover plate so as to fall onto a slide table. Upon allowing the medal to pass through a medal detection section, a slot game is started on a display. Then, when the patterns are not made uniform at all, then five medals are thrown in the vessel of the medal discharge unit. Also, after the medals are thus thrown in, when three of the same pattern are aligned with respect to all the symbols, the medals stored within the vessel of the medal discharge unit up to the time are discharged onto the slide table at one time.

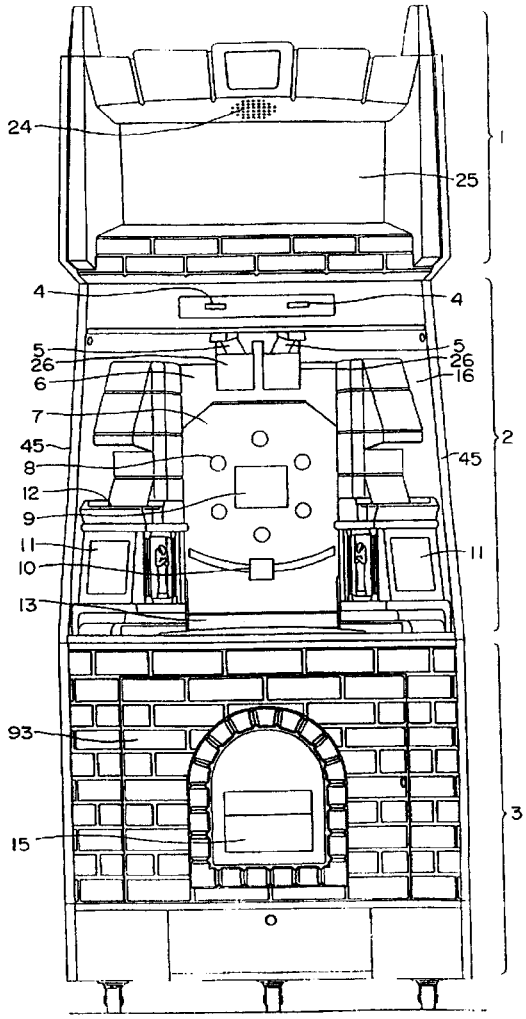

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–9 and 10, dependent on an amended claim, are determined to be patentable.

New claim 11 is added and determined to be patentable.

1. A medal game machine, comprising:

a table having an upper surface on which medals are located;

a medal pushing member slidably movable relative to and along said upper surface of said table to push the medals located on said upper surface of said table toward an edge of said upper surface of the said table;

a guide which guides medals to said upper surface of said table according to an operation by a player;

a vessel including a sidewall member surrounding a space in which medals can be accommodated, said sidewall member having a lower opening through which medals can be accommodated in said space are discharged, and a bottom plate movable between a first position in which said bottom plate closes said lower opening of said sidewall member and *a* second position in which said bottom plate opens said lower opening of said sidewall member; and a first supply mechanism which transfers medals accommodated in said vessel to said upper surface of said table by moving said bottom plate from said first position to said second position when a first condition is [satisfied] *determined;*

*wherein said first condition is determined based upon a path taken by at least one of the medals while moving along said guide.*

*11. A medal game machine as claimed in claim 1, wherein said guide has a plurality of random paths which guide medals to said upper surface of said table according to an operation by a player.*

* * * * *